US011641904B1

(12) United States Patent
Leon

(10) Patent No.: US 11,641,904 B1
(45) Date of Patent: May 9, 2023

(54) HELMET

(71) Applicant: Lionhead Helmet Intellectual Properties, LP, Ambler, PA (US)

(72) Inventor: Robert L. Leon, Ambler, PA (US)

(73) Assignee: LIONHEAD HELMET INTELLECTUAL PROPERTIES, LP, Ambler, PA (US)

( * ) Notice: Subject to any disclaimer, the term of this patent is extended or adjusted under 35 U.S.C. 154(b) by 0 days.

(21) Appl. No.: 17/983,736

(22) Filed: Nov. 9, 2022

(51) Int. Cl.
*A42B 3/06* (2006.01)

(52) U.S. Cl.
CPC ..... *A42B 3/063* (2013.01); *A42B 3/069* (2013.01)

(58) Field of Classification Search
CPC ..... A42B 3/069; A42B 3/063
USPC ..... 2/411
See application file for complete search history.

(56) References Cited

U.S. PATENT DOCUMENTS

| | | | | |
|---|---|---|---|---|
| 2,835,313 | A | 5/1958 | Dodge | |
| 3,425,061 | A | 2/1969 | Webb | |
| 3,577,562 | A | 5/1971 | Holt | |
| 3,877,076 | A | 4/1975 | Summers et al. | |
| 3,943,572 | A | 3/1976 | Aileo | |
| 4,290,149 | A * | 9/1981 | Aileo | A42C 2/007 2/909 |
| 4,307,471 | A | 12/1981 | Lovell | |
| 4,345,338 | A | 8/1982 | Frieder, Jr. et al. | |
| 4,534,068 | A | 8/1985 | Mitchell et al. | |
| 4,586,200 | A | 5/1986 | Poon | |
| 5,030,501 | A | 7/1991 | Colvin et al. | |
| 5,204,998 | A | 4/1993 | Liu et al. | |
| 5,589,016 | A | 12/1996 | Hoopingarner et al. | |
| 5,713,082 | A | 2/1998 | Bassette et al. | |

(Continued)

FOREIGN PATENT DOCUMENTS

| | | | |
|---|---|---|---|
| CN | 101850638 | A | 10/2010 |
| DE | 4226588 | A1 | 2/1994 |

(Continued)

OTHER PUBLICATIONS

Rowson et al., "Linear and Angular Head Acceleration Measurements in Collegiate Football," Journal of Biomechanical Engineering, Vo. 131, 7 pages (Jun. 2009).

(Continued)

*Primary Examiner* — Timothy K Trieu
(74) *Attorney, Agent, or Firm* — Panitch Schwarze Belisario & Nadel LLP

(57) ABSTRACT

A helmet that includes a subliner shell comprised of a hard impact resistant material. The shell has inner and outer surfaces. A subliner element having a first foam pad having a top surface and a bottom surface. The top surface is attached to the inner surface of the shell. A second foam pad is constructed of an energy absorbing viscoelastic foam material that is radially partitioned into individual segments. The segments are nested with respect to each other such that the nested segments have side surfaces in slidable direct contacting engagement with side surfaces of adjacent nested segments. The second foam pad has a top surface attached to the bottom surface of the first foam pad. A third foam pad has a top surface and a bottom surface, with the top surface of the third foam pad being attached to the bottom surface of the second foam pad.

27 Claims, 14 Drawing Sheets

(56) References Cited

U.S. PATENT DOCUMENTS

| | | | | |
|---|---|---|---|---|
| 5,815,846 | A | 10/1998 | Calonge | |
| 5,956,777 | A | 9/1999 | Popovich | |
| 5,970,550 | A | 10/1999 | Gazes | |
| 6,070,271 | A | 6/2000 | Williams | |
| 6,070,905 | A | 6/2000 | Renault | |
| 6,219,850 | B1 | 4/2001 | Halstead et al. | |
| 6,298,497 | B1 | 10/2001 | Chartrand | |
| 6,308,490 | B1 | 10/2001 | Saebi | |
| 6,324,700 | B1 | 12/2001 | McDougall | |
| 6,453,476 | B1 | 9/2002 | Moore, III | |
| 6,658,671 | B1 | 12/2003 | Von Holst et al. | |
| 6,871,525 | B2 | 3/2005 | Withnall et al. | |
| 6,934,971 | B2 | 8/2005 | Ide et al. | |
| 6,968,575 | B2 | 11/2005 | Durocher | |
| 7,240,376 | B2 | 7/2007 | Ide et al. | |
| 7,367,898 | B2 | 5/2008 | Hawkins et al. | |
| 7,461,726 | B2 | 12/2008 | Hawkins et al. | |
| 7,603,725 | B2 | 10/2009 | Harris | |
| 7,676,854 | B2 | 3/2010 | Berger et al. | |
| 7,774,866 | B2 | 8/2010 | Ferrara | |
| 7,802,320 | B2 | 9/2010 | Morgan | |
| 7,832,023 | B2 | 11/2010 | Crisco | |
| 7,900,279 | B2 | 3/2011 | Kraemer et al. | |
| 7,930,771 | B2 | 4/2011 | Depreitere et al. | |
| 7,954,177 | B2 | 6/2011 | Ide et al. | |
| 7,954,178 | B2 | 6/2011 | Durocher et al. | |
| 8,015,624 | B2 | 9/2011 | Baldackin et al. | |
| 8,127,373 | B1 | 3/2012 | Fodemski | |
| 8,166,574 | B2 | 5/2012 | Hassler | |
| 8,191,179 | B2 | 6/2012 | Durocher et al. | |
| 8,196,226 | B1 | 6/2012 | Schuh | |
| 8,347,421 | B2 | 1/2013 | Krueger | |
| 8,365,315 | B2 | 2/2013 | Ortiz et al. | |
| 8,387,164 | B2 | 3/2013 | Maddux et al. | |
| 8,402,715 | B2 | 3/2013 | Uhllg et al. | |
| 8,578,520 | B2 | 11/2013 | Halldin | |
| 8,640,267 | B1 | 2/2014 | Cohen | |
| 8,931,606 | B2 | 1/2015 | Hawkins et al. | |
| 8,955,169 | B2 | 2/2015 | Weber et al. | |
| 9,032,558 | B2 | 5/2015 | Leon | |
| 9,578,917 | B2 * | 2/2017 | Cohen | A42B 3/063 |
| 9,975,032 | B2 | 5/2018 | Frey | |
| 10,869,520 | B1 * | 12/2020 | Leon | A42B 3/063 |
| 11,547,166 | B1 * | 1/2023 | Leon | A63B 71/10 |
| 2001/0031350 | A1 | 10/2001 | Day et al. | |
| 2002/0023291 | A1 | 2/2002 | Mendoza | |
| 2002/0056521 | A1 | 5/2002 | Chen et al. | |
| 2003/0140400 | A1 | 7/2003 | Ho | |
| 2004/0117896 | A1 | 6/2004 | Madey et al. | |
| 2004/0250340 | A1 | 12/2004 | Piper et al. | |
| 2005/0246824 | A1 | 11/2005 | Berger et al. | |
| 2006/0031978 | A1 | 2/2006 | Pierce | |
| 2006/0059606 | A1 | 3/2006 | Ferrara | |
| 2006/0070170 | A1 | 4/2006 | Copeland et al. | |
| 2006/0112477 | A1 | 6/2006 | Schneider | |
| 2007/0068755 | A1 | 3/2007 | Hawkins et al. | |
| 2008/0066217 | A1 | 3/2008 | Depreitere et al. | |
| 2008/0120764 | A1 | 5/2008 | Sajic | |
| 2008/0155735 | A1 | 7/2008 | Ferrara | |
| 2008/0256685 | A1 | 10/2008 | Lampe et al. | |
| 2009/0000377 | A1 | 1/2009 | Shipps et al. | |
| 2009/0024406 | A1 | 1/2009 | Rawls-Meehan | |
| 2009/0151056 | A1 | 6/2009 | Desjardins et al. | |
| 2009/0218185 | A1 | 9/2009 | Lin | |
| 2009/0265839 | A1 | 10/2009 | Young et al. | |
| 2009/0320185 | A1 | 12/2009 | Hassler | |
| 2010/0005573 | A1 | 1/2010 | Rudd et al. | |
| 2010/0299812 | A1 | 12/2010 | Maddux et al. | |
| 2010/0319109 | A1 | 12/2010 | Field | |
| 2011/0072587 | A1 | 3/2011 | Cao et al. | |
| 2011/0107503 | A1 | 5/2011 | Morgan | |
| 2011/0117310 | A1 | 5/2011 | Anderson et al. | |
| 2011/0131695 | A1 | 6/2011 | Maddux et al. | |
| 2011/0171420 | A1 | 7/2011 | Yang | |
| 2011/0252544 | A1 | 10/2011 | Abernethy | |
| 2011/0271427 | A1 | 11/2011 | Milsom | |
| 2011/0277221 | A1 | 11/2011 | Ide et al. | |
| 2012/0047635 | A1 | 3/2012 | Finiel et al. | |
| 2012/0096631 | A1 | 4/2012 | King et al. | |
| 2012/0143526 | A1 | 6/2012 | Benzel et al. | |
| 2012/0151663 | A1 | 6/2012 | Rumbaugh | |
| 2012/0151664 | A1 | 6/2012 | Kirshon | |
| 2012/0186002 | A1 | 7/2012 | Bhatnagar et al. | |
| 2012/0186003 | A1 | 7/2012 | Heger et al. | |
| 2012/0192337 | A1 | 8/2012 | Divine et al. | |
| 2012/0198604 | A1 | 8/2012 | Weber et al. | |
| 2012/0198605 | A1 | 8/2012 | Maddux et al. | |
| 2012/0204329 | A1 | 8/2012 | Faden et al. | |
| 2012/0207964 | A1 | 8/2012 | Faden et al. | |
| 2012/0208032 | A1 | 8/2012 | Faden et al. | |
| 2012/0216339 | A1 | 8/2012 | Nimmons et al. | |
| 2012/0233745 | A1 | 9/2012 | Veazie | |
| 2012/0266365 | A1 | 10/2012 | Cohen | |
| 2012/0266366 | A1 | 10/2012 | Ferrara | |
| 2012/0297525 | A1 | 11/2012 | Bain | |
| 2012/0304366 | A1 | 12/2012 | Daoust | |
| 2012/0304367 | A1 | 12/2012 | Howard et al. | |
| 2012/0317705 | A1 | 12/2012 | Lindsay | |
| 2012/0324634 | A1 | 12/2012 | Coyle | |
| 2013/0000016 | A1 | 1/2013 | Hall et al. | |
| 2013/0000017 | A1 | 1/2013 | Szalkowski et al. | |
| 2013/0000018 | A1 | 1/2013 | Rudd et al. | |
| 2013/0007950 | A1 | 1/2013 | Arai | |
| 2013/0019384 | A1 | 1/2013 | Knight | |
| 2013/0019385 | A1 | 1/2013 | Knight | |
| 2013/0025031 | A1 | 1/2013 | Laperriere et al. | |
| 2013/0025032 | A1 | 1/2013 | Durocher et al. | |
| 2013/0025033 | A1 | 1/2013 | Durocher et al. | |
| 2013/0036531 | A1 | 2/2013 | Belanger et al. | |
| 2013/0040524 | A1 | 2/2013 | Halldin et al. | |
| 2013/0042397 | A1 | 2/2013 | Halldin | |
| 2013/0055488 | A1 | 3/2013 | Garneau | |
| 2013/0061371 | A1 | 3/2013 | Phipps et al. | |
| 2013/0061372 | A1 | 3/2013 | Goldstein | |
| 2013/0061375 | A1 | 3/2013 | Bologna et al. | |
| 2013/0111654 | A1 | 5/2013 | Gorsen et al. | |
| 2013/0122256 | A1 | 5/2013 | Kleiven et al. | |
| 2013/0185837 | A1 | 7/2013 | Phipps et al. | |
| 2013/0254978 | A1 | 10/2013 | McInnis et al. | |
| 2013/0291289 | A1 | 11/2013 | Szalkowski et al. | |
| 2013/0340147 | A1 | 12/2013 | Giles | |
| 2014/0013492 | A1 | 1/2014 | Bottlang et al. | |
| 2014/0020158 | A1 | 1/2014 | Parsons et al. | |
| 2014/0096311 | A1 | 4/2014 | Halldin | |
| 2014/0170372 | A1 | 6/2014 | Fink | |
| 2014/0196198 | A1 * | 7/2014 | Cohen | A42B 3/063 2/414 |
| 2014/0196998 | A1 | 7/2014 | Nauman et al. | |
| 2015/0000018 | A1 | 1/2015 | Brandt | |
| 2015/0223546 | A1 | 8/2015 | Cohen | |
| 2016/0021965 | A1 | 1/2016 | Mayerovitch | |
| 2017/0065018 | A1 | 3/2017 | Lindsay | |
| 2018/0249778 | A1 | 9/2018 | Brandt et al. | |
| 2019/0029352 | A1 | 1/2019 | Sadegh et al. | |

FOREIGN PATENT DOCUMENTS

| | | | |
|---|---|---|---|
| EP | 1142495 | A1 | 10/2001 |
| GB | 2530309 | A | 3/2016 |
| WO | 2004032659 | A1 | 4/2004 |
| WO | 2020236930 | A1 | 11/2020 |

OTHER PUBLICATIONS

Broglio et al., "Biomechanical Properties of Concussions in High School Football," Medicine and Science in Sports Exercise; www.medscape.com, pp. 1-10, (Nov. 23, 2010).

Greenwald et al., "Head Impact Telemetry System (HITSTM) for Measurement of Head Acceleration in the Field," American Society of Biomechanics—2003 Annual Meeting, 2 pages.

Daniel et al., "Head Impact Exposure in Youth Football," Annals of Biomedical Engineering, 6 pages (Feb. 15, 2012).

(56) References Cited

OTHER PUBLICATIONS

ASTM F 1446-04, "Standard Test Methods for Equipment and Procedures Used in Evaluating the Performance Characteristics of Protective Hedgear," ASTM International, pp. 1-11 (date: unknown).
"Head Injuries in Football," The New York Times, pp. 4 (Nov. 16, 2011).
Rousseau et al., "A Comparison of Peak Linear and Angular Headform Accelerations Using Ice Hockey Helmets," Journal of ASTM International; www.astm.org, vol. 6, No. 1, 11 pages (Feb. 20, 2009).
Rowson et al., "Development for the STAR Evaluation System for Football Helmets: Integrating Player Head Impact Exposure and Risk of Concussion," Annals of Biomedical Engineering, 11 pages (May 7, 2011).
Rousseau et al., "The Influence of Deflection and Neck Compliance on the Impact Dynamics of a Hybrid III Headform," Proceedings of the Institution of Mechanical Engineers, vol. 223, Part P: J. Sports Engineering and Technology, pp. 89-97 (Apr. 3, 2009).
"2011 Concussion Report—End of Regular Season," 4 pages (Jan. 10, 2012).
Shipley, "Traumatic Brain Injury and Diffuse Axonal Injury," Trial Image Inc.; www.trialimagestore.com, pp. 1-5 (Feb. 18, 2011).
Newman et al., "A New Biomechanical Assessment of Mild Traumatic Brain Injury Part 2—Results and Conclusions," 11 pages, (date: unknown).
King et al., "Is Head Injury Caused by Linear or Angular Acceleration?," IRCOBI Conference, pp. 1-12 (Sep. 2003).
NOCSAE Doc (ND) 001-11M11, "Standard Test Method and Equipment Used in Evaluating the Performance Characteristics of Protective Headgear Equipment," NOCSAE/National Operating Committee on Standards for Athletic Equipment, pp. 1-25 (Jan. 2012).
NOCSAE Doc (ND) 002-11m11a, "Standard Performance Specification for Newly Manufactured Football Helmets," NOCSAE/National Operating Committee on Standards for Athletic Equipment, pp. 1-6 (Feb. 2012).
"NOCSAE receives $1.1M Research Grants to Advance Science of Sports Medicine," 2 pages (Jun. 20, 2011).
"Helmet Safety Group Approves Research Grants," SFGate.com, 1 page (Jun. 18, 2011).
Bartholet, "The Collision Syndrome," Scientific American, pp. 68-71 (Feb. 2012).
Kluger, "Headbanger Nation. Concussions are clobbering U.S. kids. Here's why," Time Magazine, pp. 42-51 (Jan. 31, 2011).
"Concussion," Wikipedia, 17 pages (page last modified on May 21, 2012).
"Frustoconical," Wiktionary, N.p., n.d. Web. Aug. 4, 2015.
"Frustum." Wiktionary. N.p., n.d. Web. Aug. 4, 2015.
"EZ Dri." INOAC. INOAC, n.d. Web Mar. 2, 2016.
"Outdoor Foam Cushion, Waterproof Foam, Patio Cushion, Furniture Cushions." Outdoor Foam Cushion, Waterproof Foam, Patio Cushion, Furniture Cushions. N.p., n.d. Web Mar. 2, 2016.
"Reticulated Polyurethane Foam", Producer of Custom-Engineered Components, Products & Packaging, 4 pages (Oct. 2016).
Qi, HJ and Boyce, MC, Stress-strain Behavior of Thermoplastic Polyurethane. Submitted to Mechanics of Materials. Submitted Dec. 2003, Revised Jul. 2004.
Orringer, et al., Crash Padding Research, vol. 1, Material Mechanical Properties, Final Report, Accessed through the National Academies of Sciences, Engineering Medicine, 1986-87.

* cited by examiner

HELMET

BACKGROUND OF THE INVENTION

The present disclosure generally relates to a helmet whose purpose is to protect a wearer's head during a head impact. Extending radially outward from the wearer's head, the helmet may consist of one or multiple liner portions and one or multiple shell portions. Either way, there is typically a liner portion in contact with the wearer's head initially or during impact, that liner portion being herein defined as the subliner. The subliner may be comprised of individual subliner elements. The subliner is typically attached to an inner shell portion, the term inner having been added to unambiguously differentiate it from an outer shell portion in the case of a helmet with multiple shell portions. In helmets having just a single liner portion and a single shell portion, the liner portion would be the same as the subliner and the shell portion would be the same as the inner shell portion. In some helmets (typically hockey helmets) the inner shell portion may consist of individual shell segments. The subliner and inner shell portion together are herein defined as the helmet subliner system, and the present disclosure comprises an improved helmet subliner system, and an improved outer liner portion in the case of multiple shell helmets, to better protect the wearer from sustaining concussions and other head injuries.

Especially in multiple liner, multiple shell helmets, the subliner, as defined herein has been used primarily for obtaining the best fit and best comfort for the wearer. But as will be shown in this specification, the subliner, and more generally the subliner system may also be used to substantially improve the head protection performance of the helmet. The disclosure recognizes and takes advantage of the fact that all the forces that are applied to the wearer's head during a head impact are preferably applied through the subliner and its elements.

Recent postmortem brain investigations have found a high instance of chronic traumatic encephalopathy, or CTE, in the donated brains of deceased NFL football players, many of whom had suffered debilitating symptoms during their lifetimes, including unexplained rage, extreme mood swings, and substantial cognitive degeneration, all of which may have begun years after their football playing ended. Current research shows that CTE can almost always be traced back to long term repetitive head impacts which may include both concussive and sub-concussive impacts. It is believed those impacts would have been characterized by a high level of head angular acceleration, sometimes called rotational acceleration. The improved helmet subliner system configuration of the present disclosure is specifically designed to help reduce the level of head angular acceleration during a head impact.

The present disclosure generally relates to a helmet whose purpose is to protect a wearer's head during an impact. More specifically, it relates to an improved version of the helmet disclosed in U.S. Pat. No. 10,869,520, the contents of which are hereby incorporated by reference in their entirety. U.S. Pat. No. 10,869,520 discloses a subliner element to be located at the top of the head when the helmet is worn. The term subliner refers to liner elements that may come in contact with a wearer's head. The top subliner element is comprised of an energy absorbing viscoelastic foam material capable of exhibiting a compressive stress of at least 50 psi for a dynamic compression of 50%, and the element has a substantially flat lower surface which is also substantially tangent to the surface of the wearer's head beneath it when the helmet is worn. That latter requirement is to enable the liner element to slide by the wearer's head in the event of a horizontal impact while imparting little or no horizontal force to the wearer's head and to thereby substantially reduce the resulting angular acceleration (the main cause of concussions) about a horizontal axis oriented perpendicular to the impact direction. The design concept works well, but could function better where the mostly horizontal impact is accompanied by a substantial downwardly directed impact force. In that case the lower surface of the foam element may be pushed downward to at least partially conform with the curved top surface of the wearer's head, thereby precluding the element from sliding by the wearer's head without exerting a substantial horizontal force as was the desired purpose.

The present invention describes three alternative, structurally different designs of the top subliner element to result in, in the case of a significant horizontal impact in the presence of a significant downwardly directed impact force, a substantially lessened horizontal force being applied to the wearer's head at the place where it contacts the top subliner element.

SUMMARY OF THE INVENTION

Briefly stated, the present disclosure is directed to a helmet adapted to be worn on a head of a wearer. The head has a top area centered about a top of the wearer's head encompassing approximately 0.44 to 7 square inches. The helmet includes a subliner shell comprised of a hard impact resistant material. The shell has inner and outer surfaces. The shell is adapted to surround at least a portion of the cranial part of the wearer's head with the inner surface of the shell being spaced from the wearer's head at an initial pre-impact relative position when the helmet is worn. At least one subliner element extends from the inner surface of the shell at a location such that the subliner element is adapted to be aligned with the top area when the helmet is worn. The at least one subliner element includes a first foam pad constructed of an energy absorbing viscoelastic foam material having a top surface and a bottom surface. The top surface is attached to the inner surface of the shell. A second foam pad is constructed of an energy absorbing viscoelastic foam material that is radially partitioned into individual and independent segments. The independent segments are nested with respect to each other such that the nested segments have side surfaces in slidable direct contacting engagement with side surfaces of adjacent nested segments. The second foam pad has a top surface attached to the bottom surface of the first foam pad. A third foam pad is constructed of an energy absorbing viscoelastic foam material having a top surface and a bottom surface, with the top surface of the third foam pad being attached to the bottom surface of the second foam pad. The bottom surface of the third foam pad is a substantially flat surface which is substantially tangent to the surface of the wearer's head beneath it when the helmet is worn.

Briefly stated, in another aspect the present disclosure is directed to a helmet adapted to be worn on a head of a wearer. The head has a pair of eyebrows, a pair of ears and an annular headband shaped area encircling the wearer's head. The headband shaped area is approximately 0.75 to 1.25 inches wide and has a lower edge defining a plane positioned approximately 0.5 to 1.5 inches above the eyebrows and approximately 0.25 to 0.75 inches above an upper junction of the ears and the wearer's head. A top area is centered about a top of the wearer's head and encompasses approximately 0.44 to 7 square inches. A middle area of the head is defined between the headband area and the top area. The helmet includes a subliner shell comprised of a hard impact resistant material. The shell has inner and outer surfaces and is adapted to surround at least a portion of the cranial part of the wearer's head with the inner surface of the shell being spaced from the wearer's head at an initial pre-impact relative position when the helmet is worn. A subliner, at least a part of which is adapted to be in contact with the wearer's head when the helmet is worn prior to an impact and during an impact, includes a plurality of a first type of subliner elements extending from the inner surface of the shell at a location such that the first type of subliner elements are adapted to be aligned with the headband area when the helmet is worn. The first type of subliner elements are constructed of an energy absorbing viscoelastic foam material and are radially partitioned into individual and independent segments. The independent segments are nested with respect to each other with double-sided nano tape positioned therebetween such that the nested segments have side surfaces in direct contacting engagement with the nano tape. At least one of a second type of subliner element extends from the inner surface of the shell at a location such that the at least one of the second type of subliner element is adapted to be aligned with the middle area when the helmet is worn. The at least one of the second type of subliner element is constructed of a foam material. A third type of subliner element extends from the inner surface of the shell at a location such that the third type of subliner element is adapted to be aligned with the top area when the helmet is worn. The third type of subliner element includes a first foam pad constructed of an energy absorbing viscoelastic foam material having a top surface and a bottom surface. The top surface is attached to the inner surface of the shell. A second foam pad is constructed of an energy absorbing viscoelastic foam material and is radially partitioned into individual and independent segments. The independent segments are nested with respect to each other such that the nested segments have side surfaces in slidable direct contacting engagement with side surfaces of adjacent nested segments. The second foam pad has a top surface attached to the bottom surface of the first foam pad. A third foam pad is constructed of an energy absorbing viscoelastic foam material having a top surface and a bottom surface, The top surface of the third foam pad being attached to the bottom surface of the second foam pad. The bottom surface of the third foam pad is a substantially flat surface which is substantially tangent to the surface of the wearer's head beneath it when the helmet is worn. The at least one of the second type of subliner element is positioned between the plurality of the first type of subliner elements and the third type of subliner element.

Briefly stated, in another aspect the present disclosure is directed a helmet adapted to be worn on a head of a wearer. The head has a top area centered about a top of the wearer's head encompassing approximately 0.44 to 7 square inches. The helmet includes a subliner shell comprised of a hard impact resistant material. The shell has inner and outer surfaces. The shell is adapted to surround at least a portion of the cranial part of the wearer's head with the inner surface of the shell being spaced from the wearer's head at an initial pre-impact relative position when the helmet is worn. At least one subliner element extends from the inner surface of the shell at a location such that the subliner element is adapted to be aligned with the top area when the helmet is worn. The at least one subliner element extending from the inner surface of the shell at a location such that the subliner element is adapted to be aligned with the top area when the helmet is worn. The at least one subliner element includes a first foam pad constructed of an energy absorbing viscoelastic foam material having a top surface and a bottom surface, with the top surface being attached to the inner surface of the shell. The bottom surface is generally planar and has a first fluoropolymer coating adhered thereto. A second foam pad is constructed of an energy absorbing viscoelastic foam material having a top surface and a bottom surface. The top surface of the second foam pad is generally planar and has a second fluoropolymer coating adhered thereto. The first and second foam pads are positioned with the first and second fluoropolymer coatings in sliding facing engagement. The bottom surface of the second foam pad is a substantially flat surface which is substantially tangent to the surface of the wearer's head beneath it when the helmet is worn.

Briefly stated, in another aspect the present disclosure is directed to a helmet adapted to be worn on a head of a wearer. The head has a pair of eyebrows, a pair of ears and an annular headband shaped area encircling the wearer's head. The headband shaped area is approximately 0.75 to 1.25 inches wide and has a lower edge defining a plane positioned approximately 0.5 to 1.5 inches above the eyebrows and approximately 0.25 to 0.75 inches above an upper junction of the ears and the wearer's head. A top area is centered about a top of the wearer's head and encompasses approximately 0.44 to 7 square inches. A middle area of the head is defined between the headband area and the top area. The helmet includes a subliner shell comprised of a hard impact resistant material. The shell has inner and outer surfaces and is adapted to surround at least a portion of the cranial part of the wearer's head with the inner surface of the shell being spaced from the wearer's head at an initial pre-impact relative position when the helmet is worn. A subliner, at least a part of which is adapted to be in contact with the wearer's head when the helmet is worn prior to an impact and during an impact, includes a plurality of a first type of subliner elements extending from the inner surface of the shell at a location such that the first type of subliner elements are adapted to be aligned with the headband area when the helmet is worn. The first type of subliner elements is constructed of an energy absorbing viscoelastic foam material and is radially partitioned into individual and independent segments. The independent segments are nested with respect to each other with double-sided nano tape positioned therebetween such that the nested segments have side surfaces in direct contacting engagement with the nano tape. At least one of a second type of subliner element extends from the inner surface of the shell at a location such that the at least one of the second type of subliner element is adapted to be aligned with the middle area when the helmet is worn. The at least one of the second type of subliner element is constructed of a foam material. A third type of subliner element extends from the inner surface of the shell at a location such that the third type of subliner element is adapted to be aligned with the top area when the helmet is worn. The third type of subliner element includes a first foam pad constructed of an energy absorbing viscoelastic foam material having a top surface and a bottom surface. The top surface being attached to the inner surface of the shell. The bottom surface is generally planar and has a first fluoropolymer coating adhered thereto. A second foam pad is constructed of an energy absorbing viscoelastic foam material having a top surface and a bottom surface. The top surface of the second foam pad is generally planar and has a second fluoropolymer coating adhered thereto. The first and second foam pads being positioned with the first and second fluoropolymer coatings being in sliding facing engagement. The bottom surface of the second foam pad is a substantially flat surface which is substantially tangent to the surface of the wearer's head beneath it when the helmet is worn. The at least one of the second type of subliner element is positioned between the plurality of the first type of subliner elements and the third type of subliner element.

BRIEF DESCRIPTION OF THE DRAWINGS

The foregoing summary, as well as the following detailed analysis of the physical principles and detailed descriptions of the preferred embodiments will be better understood when read in conjunction with the appended drawings. For the purpose of illustrating the disclosure, particular arrangements and methodologies of preferred embodiments are shown in the drawings. It should be understood, however, that the disclosure is not limited to the precise arrangements or instrumentalities shown or the methodologies of the detailed description. In the drawings.

DETAILED DESCRIPTION OF THE INVENTION

Figure 1:
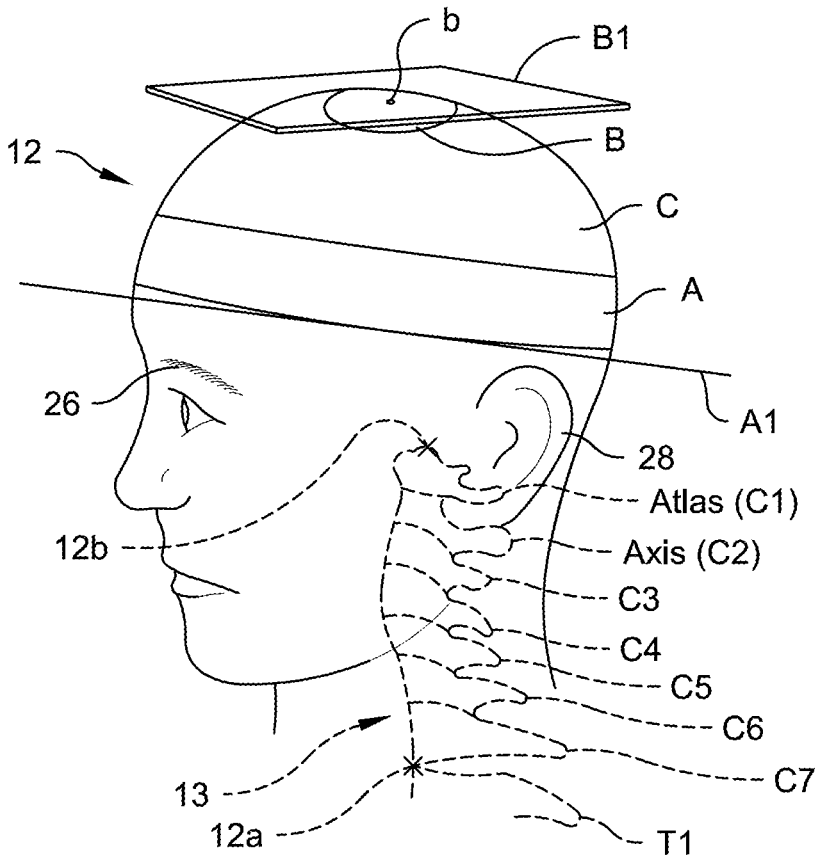
FIG. 1 is a perspective side view of a wearer's head with defined areas, planes, and points in accordance with the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the helmet, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import. The terms "angular acceleration" and "rotational acceleration" should be taken as synonymous from a force vector perspective. Similarly, the words "acceleration" and "deceleration" should also be taken as synonymous from a force vector perspective. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
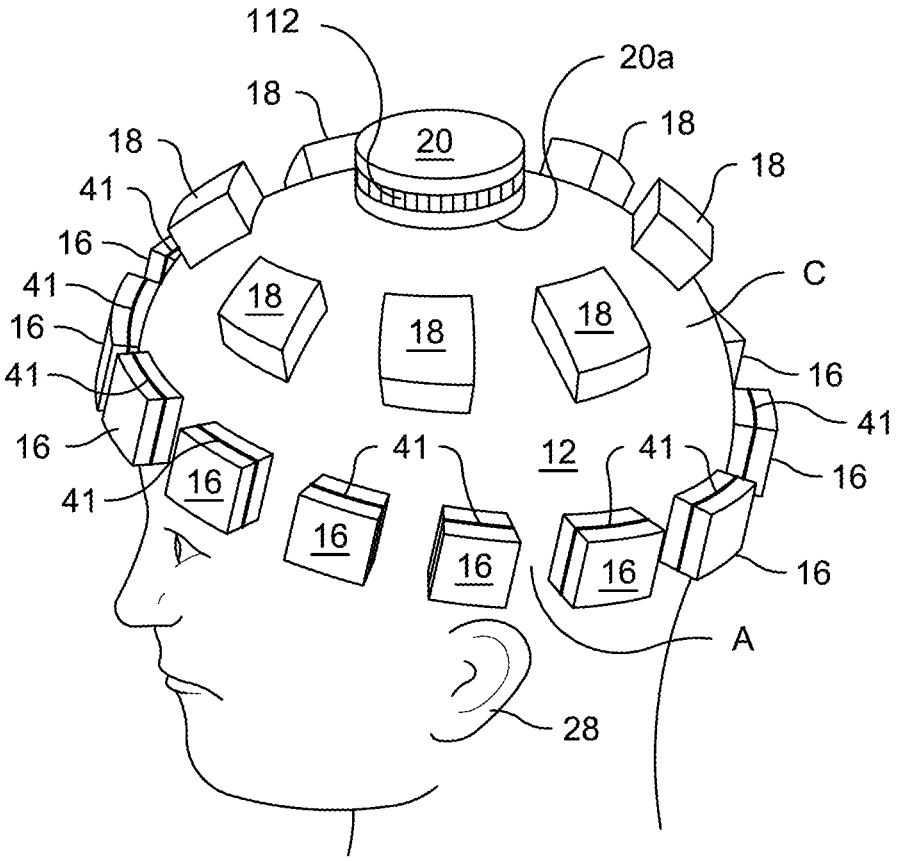
FIG. 2 is a perspective upper side view of a wearer's head showing the three types of subliner elements as they would be located in their respective designated areas, in accordance with a first embodiment of the present disclosure.
Figure 4:
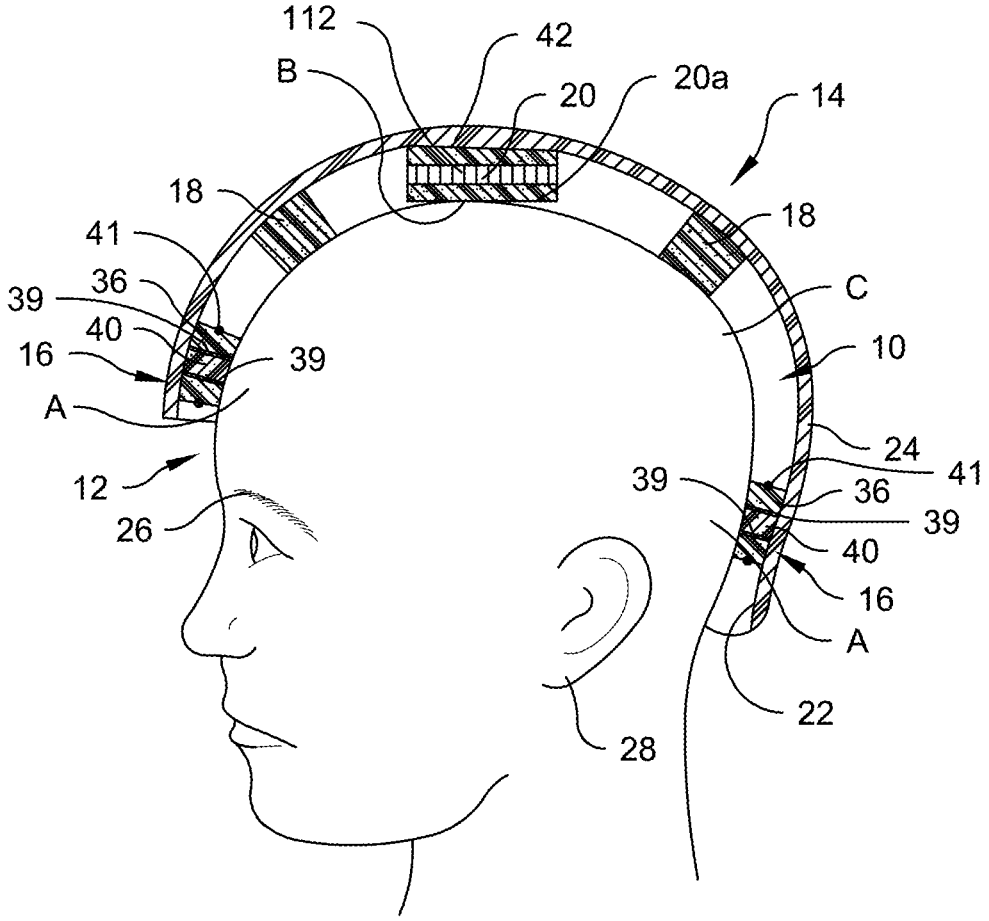
FIG. 4 is cross-sectional side view at the midsagittal plane of a wearer's head, showing the subliner elements of FIG. 2 and the inner shell to which they are attached forming a subliner system in accordance with the present disclosure.

Referring now to FIGS. 1, 2 and 4, to best understand the configuration of the helmet subliner system or subliner 10, which is a subject of this disclosure, it will be useful to first define certain areas of a potential wearer's head 12 which could come in contact with various types of subliner elements of the helmet 14. In this regard, all the following will be defined: first area A, first plane A1, second plane B1, point b, second area B, and third area C.

FIG. 1 is a perspective side view of a wearer's head 12 having a pair of eyebrows 26 (only one is shown) and a pair of ears 28 (only one is shown). The head 12 includes a first area A, first plane A1, second plane B1, point b, second area B, and third area C. First area A is an annular headband shaped area encircling the wearer's head 12. The first or headband shaped area A being approximately 0.75 to 1.25 inches wide, and preferably approximately 1.0 inch wide, and having a lower edge defining a plane positioned approximately 0.5 to 1.5 inches, and preferably approximately 1.0 inch, above the eyebrows 26 and approximately 0.25 to 0.75 inches, and preferably approximately 0.5 inches, above a location where the ears 28 join the wearer's head 12 at the top or, stated differently, an upper junction of the ears 28 and the wearer's head 12. The first plane A1 is a hypothetical plane defined by the lower edge of first area A. Picture second plane B1 as a lower cover of an imaginary hard cover book being balanced horizontally atop the wearer's head 12 while the wearer's head 12 is maintained in an upright position, tilted neither right nor left, nor forward nor backward and where point b is approximately the center of the contact area between the lower cover of the imaginary book and the wearer's head 12. Notice that first plane A1 is tilted upward in the forward direction (the direction toward the face of the wearer) relative to second plane B. In FIG. 1, the second plane B1 is shown as transparent so that the contact area with the wearer's head 12, point b, is apparent. The second or top area B is formed by a planar projection of an approximate 2-inch diameter circle (not shown) formed in the second plane B1 centered about point b onto the wearer's head. That is, the second area B is generally circular and is centered about a top of the wearer's head 12 and extends 0.75 to 3 inches, and preferably 2 inches, in diameter in all lateral directions. As will be discussed, the second area B needn't be 2 inches in diameter, nor even circular. That is, the second area B can range from 0.44 to 7 square inches, or preferably 3.14 square inches. The third or middle area C is the area on the wearer's head 12 between first area A and second area B.

Referring again to FIGS. 1, 2 and 4 and as will be described in detail in subsequent sections of the specification, subliner elements of a first type 16 are to be located in the first area A; subliner elements of a second type 18 are to be utilized in third area C, and a subliner element of a third type 20 is to be used in second area B. Each type of subliner element 16, 18, 20 has its own specific physical characteristics in accordance with the purpose of the disclosure which is to be able to reduce the level of head angular acceleration imparted to a wearer's head 12 during a head impact, regardless of the location or direction of the impact. Each of the subliner elements 16, 18, 20 is to be attached to an inner surface 22 of the inner shell 24 of the helmet 14, preferably utilizing a commonly employed hook and loop type of fastener arrangement which allows for the simple assembly of, and changeout of, individual subliner elements 16, 18, 20 during a fitting process, with each subliner element 16, 18, 20 being positioned and sized in its thickness direction to best fit the size and shape of a wearer's head 12. It will be appreciated by one skilled in the art, that other fastening elements could be used to releasably secure the subliner elements 16, 18, 20 to the inner surface 22 of the inner shell 24 of the helmet 14, such as a releasable adhesive (not shown).

FIG. 2 is a perspective upper side view of a wearer's head 12 showing the first, second and third types of subliner elements 16, 18, 20 as they would be located in their respective designated areas shown in FIG. 1, in accordance with a first embodiment of the present disclosure. The individual subliner elements 16, 18, 20 are not attached to the wearer's head 12 (as could be falsely assumed from FIG. 2) but are merely illustrated in the figure where they would be located with respect to the wearer's head 12 when the helmet 14 is worn. Typically, they would be attached to the inner surface 22 of the inner shell 24 of the helmet 14, as shown in FIG. 4, preferably utilizing a commonly employed hook and loop type of fastener arrangement, describe below. The upper side viewpoint enables a fuller view of a first embodiment of a subliner element of the third type 20, which is preferably disc or oval shaped, oriented generally in the second plane B1, and is centered about point b at the top, or crown, of the head 12. Subliner element of the third type 20 has a flat (or nearly flat), horizontal (or nearly horizontal), lower surface 20*a* which may be either initially in contact with the wearer's head 12 or slightly spaced therefrom but may come into contact with the wearer's head 12 during an impact. Subliner element of the third type 20 is shown here as a circular disc having a two-inch diameter to accommodate any misalignment of the center of the disc with the initial actual point of contact with a wearer's head 12 and to accommodate lateral displacements between the inner shell 24 and the wearer's head 12 during an impact. In general, the subliner element of the third type 20 need not be circular, but it may be of any suitable contiguous shape typically having that approximate area or greater. The important thing is that its lower surface 20*a* be of sufficient area to enable the accommodations described above, and that it be predominately flat and horizontal such that it is substantially tangent to the surface of the wearer's head 12 beneath it when the helmet 14 is worn.

To be able to appreciate why the lower surface 20*a* of subliner element of the third type 20 is preferred to be flat and horizontal, one may perform a simple experiment with one's own hand and one's own head. First, using one's hand, firmly cup the top of one's head. Then while still firmly cupping the head, forcefully move the cupping hand's forearm forward and backward, and side to side, and notice how the head is forced into violent motion likely involving significant head angular accelerations. Next, repeat the experiment while the hand is held flat and horizontal. The result:

almost no forced motion of the head, and thus no head angular acceleration.

Figure 4A:
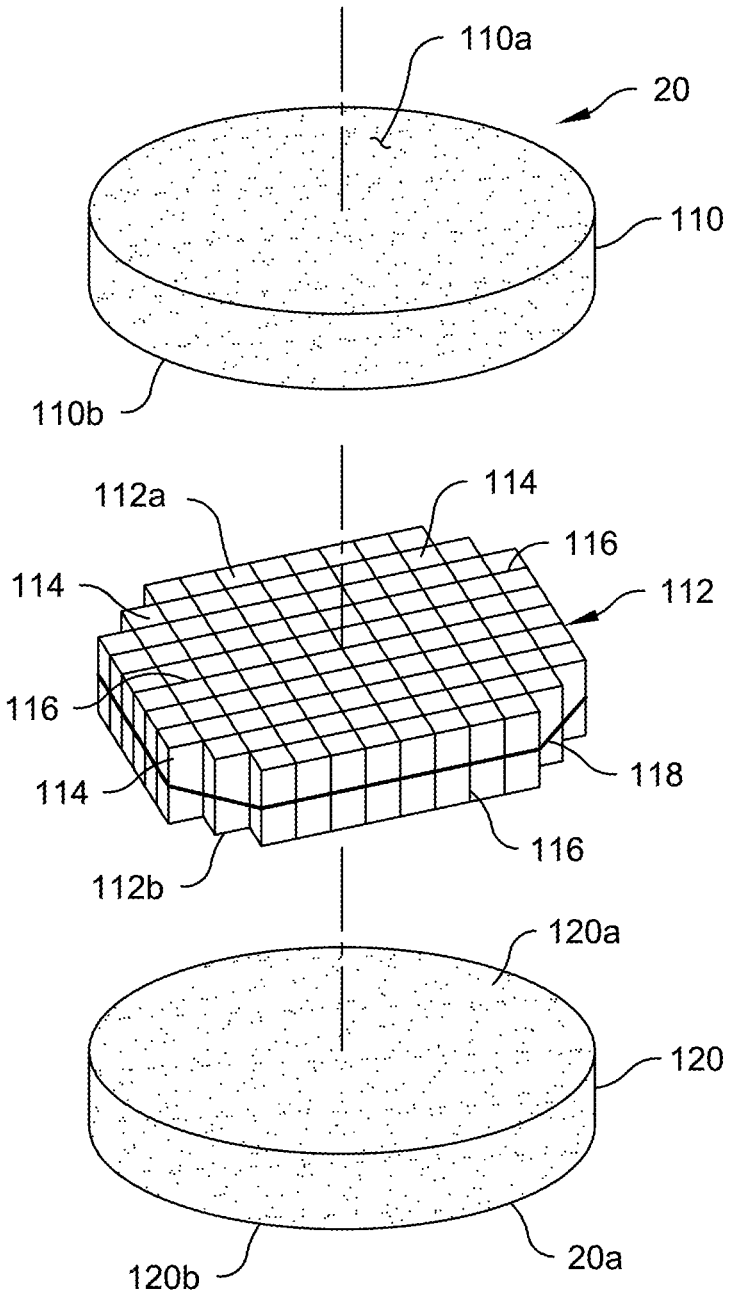
FIG. 4A is an exploded top perspective view of a first embodiment of a third type of subliner element in accordance with the present disclosure.

Referring now to FIGS. 2, 4 and 4A, the subliner element of the third type 20 is comprised of a first foam pad 110 constructed of an energy absorbing viscoelastic foam material having a top surface 110*a* and a bottom surface 110*b*, the top surface 110*a* being attached to the inner surface 22 of the shell 24. The first foam pad 110 is generally disk shaped and preferably made of relatively stiff, very energy absorbent, viscoelastic foam material, capable of exhibiting a compressive stress of 20 psi for a static compression of 50% and at least 50 psi for a dynamic impact type compression of 50%, for example a vinyl nitrile foam such as IMPAX®, VN600, VN740, or VN1000 by Dertex Corporation, or a polyurethane foam such as LAST-A-FOAM®, FP 8015 by General Plastics Manufacturing Company.

The subliner element of the third type 20 further includes a second foam pad 112 being constructed of an energy absorbing viscoelastic foam material that is the same as the material in the first foam pad 110. The second foam pad 112 is radially partitioned into individual and independent segments 114. The independent segments 114 are nested with respect to each other such that the nested segments 114 have side surfaces 116 in slidable direct contacting engagement with side surfaces 116 of adjacent nested segments 114. The second foam pad 112 has a top surface 112*a* attached to the bottom surface 110*b* of the first foam pad 110.

The segments 114 are in the form of a plurality of side-by-side, vertically oriented, slender foam columns or segments 114 that have substantially less sidewise stiffness than a solid foam portion. The resulting sidewise stiffness is lessened if the columns 114 are made longer, or made more slender even though that results in more columns 114 to fill the same area. The foam material of the segments 114 is preferably the same material as the rest of the first foam pad 110, although another foam material may be substituted if the other material still is capable of exhibiting a compressive stress of at least 50 psi for a dynamic compression of 50%. To make sure the segments 114 stay together during a compressive impact the second foam pad 112 and/or segments 114 are tightly surrounded by a generally inelastic cord made of a high strength, low elongation material such as KEVLAR®. The second foam pad 112 has a length or height and the cord 118 is positioned generally in the middle of the length or height.

The subliner element of the third type 20 further includes a third foam pad 120 constructed of an energy absorbing viscoelastic foam material which is the same material as the first foam pad 110. The third foam pad 120 is generally disk shaped and similarly shaped to the first foam pad 110. The third foam pad 120 has a top surface 120*a* and a bottom surface 120*b*. The top surface 120*a* of the third foam pad 120 is attached to the bottom surface 112*b* of the second foam pad 112. The bottom surface 120*a* of the third foam pad 120 is a substantially flat surface which is substantially tangent to the surface of the wearer's head 12 beneath it when the helmet 14 is worn. The bottom surface 120*a* of the third foam pad 120 forms the horizontal lower surface 20*a*, described above. The first, second and third foam pads 110, 112 and 120 are preferably secured together using a suitable adhesive that works well with foam. That is, the adhesive is preferably flexible in its cured condition to accommodate any stretching or compressing of the foam materials during an impact, as is well understood by those of ordinary skill in the art. Preferably, the slender foam columns 114 in totality enable a sidewise relative displacement between the first and second foam pads 110, 112 of at least one-half inch in response to a sidewise force of less than 100 pounds. After an impact, the slender foam columns 114 are able to return the first and second foam pads 110, 112 to their pre-impact relative position.

Figure 4B:
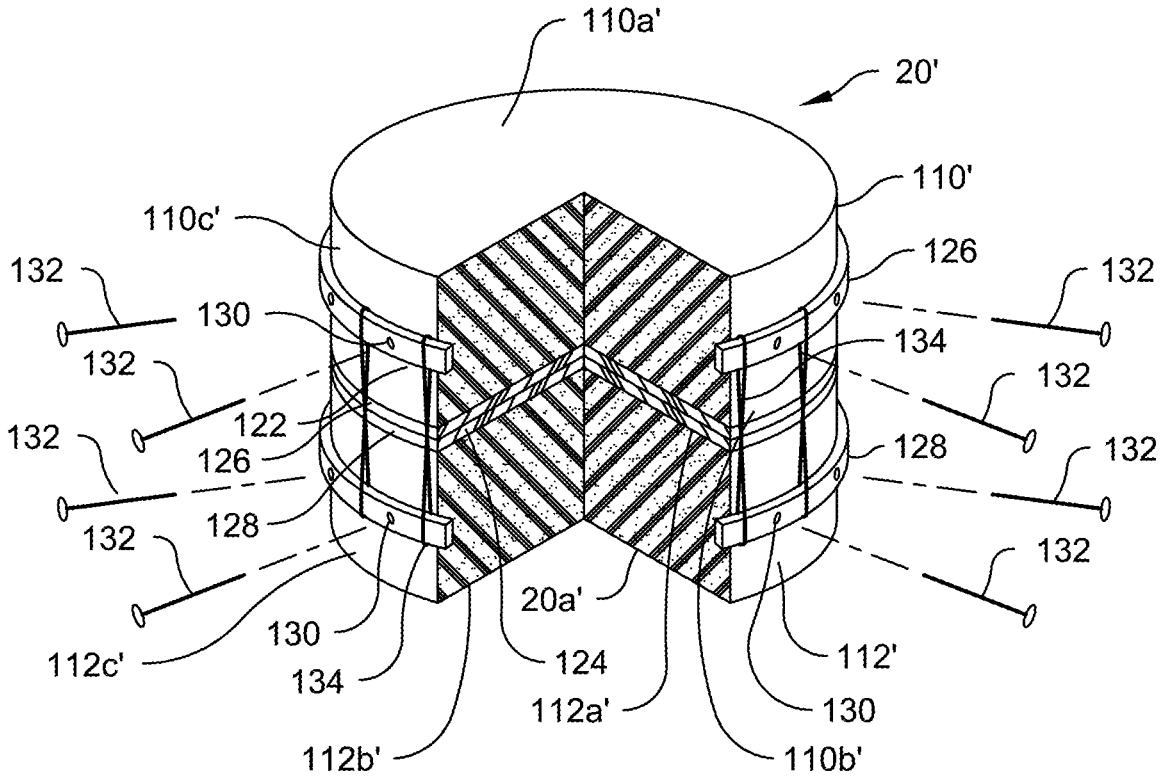
FIG. 4B is a top perspective view partially in cross section of a second embodiment of a third type of subliner element in accordance with the present disclosure.

Referring now to FIG. 4B, there is shown a second embodiment of a subliner element of the third type 20', which includes a first foam pad 110' constructed of an energy absorbing viscoelastic foam material having a top surface 110*a'* and a bottom surface 110*b'*. The top surface 110*a'* is attached to the inner surface 22 of the shell 24, as described above. The bottom surface 110*b'* is generally planar and has a first fluoropolymer coating or layer 122 adhered thereto.

The second embodiment of a subliner element of the third type 20' further includes a second foam pad 112' constructed of an energy absorbing viscoelastic foam material having a top surface 112*a'* and a bottom surface 112*b'*. The top surface 112*a'* of the second foam pad 112' is generally planar and has a second fluoropolymer layer or coating 124 adhered thereto. The first and second foam pads 110', 112' being positioned with the first and second fluoropolymer coatings 122, 124 in sliding facing engagement. The bottom surface 112*b'* of the second foam pad 112' is a substantially flat surface which is substantially tangent to the surface of the wearer's head 14 beneath it when the helmet 12 is worn. The bottom surface 112*a'* of the second foam pad 112' forms the horizontal lower surface 20*a*, described above. Both the first and second foam pads 110', 112' are generally disk shaped.

Each fluoropolymer layer 122, 124 is pre-treated on just one side to enable it to be strongly adhered to another surface. The adhering agent is an adhesive which is flexible in its cured condition to be able to accommodate any stretching or compressing of the foam materials during an impact. The first foam pad 110' has a first side surface 110*c'* extending between the top and bottom surfaces 110*a'*, 110*b'*. The second foam pad 112' has a second side surface 112*c'* extending between the top and bottom surfaces 112*a'*, 112*b'*. A first rib or band 126 is secured to the first side surface 110*c'* of the first foam pad 110'. A second rib or band 128 is secured to the second side surface 112*c'* of the second foam pad 112'. The upper and lower ribs 126, 128 surround the first foam pad 110' and the second pad 112', respectively, at near the mid height of each first side surface 110*c'* and second side surface 112*c'*. Each rib 124, 126 is preferably constructed of a polymeric material and has several holes 130 to accommodate metal pins 132 which are long enough to hold each of the ribs 126, 128 in place by being embedded in the foam. Preferably there would be between six and sixteen holes 130 and pins 132 to properly secure each rib 126, 128 to the underlying foam portion.

A biasing element extends between the first and second ribs 126, 128 to force the first and second fluoropolymer coatings 122, 124 toward each other. That is, preassembled onto the ribs 126, 128 before they are pinned into place are a plurality of small elastomer bands 134 spaced around periphery of the first and second foam pads 110', 112'. Preferably there would be a total of eighty to one hundred sixty elastomer bands 134 distributed around the circumference, each one being stretched between the upper and lower ribs 126, 128. And preferably, each elastomer band 134 is pre-twisted one time between the upper and lower ribs 126, 128 so that the two free lengths of each elastomer band 134 are equal. The free length being that section of an elastomer band 134 stretched around the upper and lower ribs 126, 128. The first and second fluoropolymer coatings 122, 124 are biased toward each other by a force applied to the first and second foam pads 110', 112' as result of the elastomer bands 134.

The material of the elastomer band 134 should have an elastic elongation capability of greater than 100% to be able to elastically accommodate the required stretch of their free lengths as the first and second fluoropolymer coatings 122, 124 slide relative to each other in response to an impact. Then after an impact the elastomer bands 134 return the first and second foam pads 110', 112' to their pre-impact relative position.

Figure 4C:
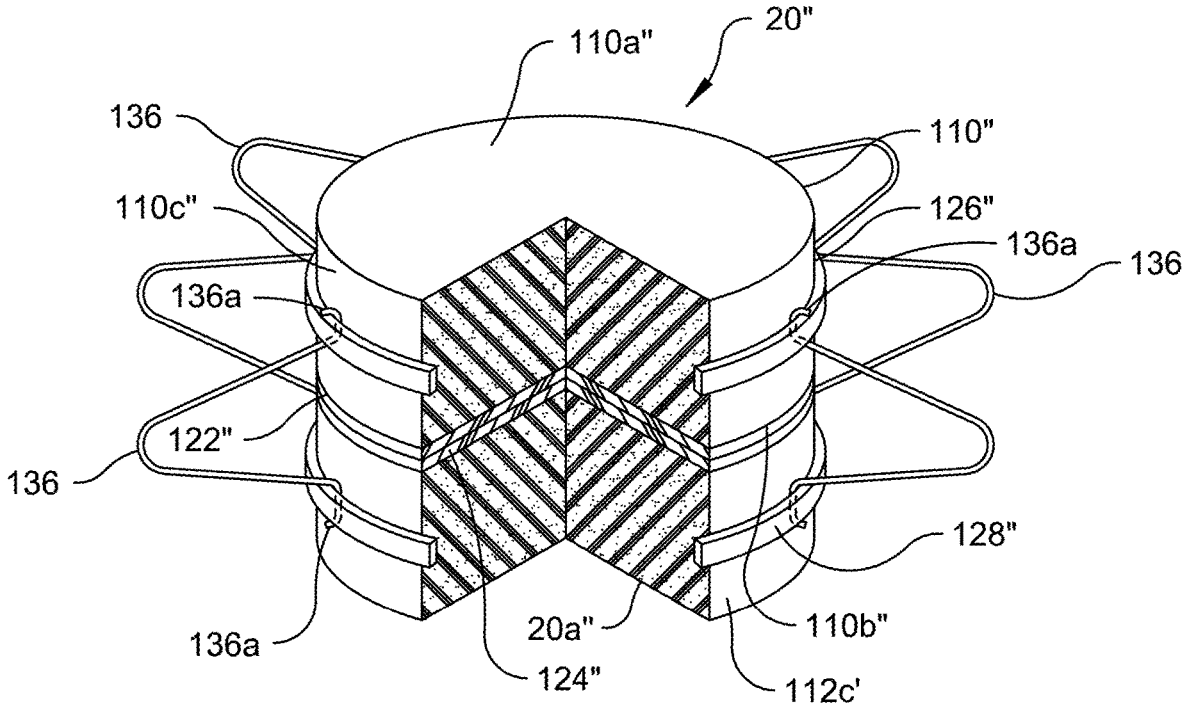
FIG. 4C is a top perspective view partially in cross section of a third embodiment of a third type of subliner element in accordance with the present disclosure.

Referring now to FIG. 4C, there is shown a third embodiment of a subliner element of the third type 20". The third embodiment of the subliner element of the third type 20" is identical to the second embodiment of the subliner element of the third type 20', except that the plurality of elastomer bands 34 have been replaced with a plurality of spring elements 136 described in more detail below. Accordingly, only the differences between the third embodiment of the subliner element of the third type 20" and the second embodiment of the subliner element of the third type 20' will be described, with like double prime element numbers being used for the third embodiment of the subliner element 20". The spring element 136 is preferably in the form of a generally V-shaped wire. The spring elements 136 shown in FIG. 4C are shown in an installed, mostly unstressed configuration. Each spring element 136 would be typically comprised of metal or polymer plastic. If metal, it could be hardened stainless steel having a yield strength of greater than 200,000 psi. If polymer plastic, it could be a polymer having very good spring properties such as acetal. The spring elements 136 illustrated in FIG. 4C exhibit a high yield strength and are constructed of 10 mil diameter stainless steel spring having a length of approximately 1 inch in its long dimension. Each spring element 136 has two flattened and curved hook-like terminal ends 136*a* that fit securely behind the upper and lower ribs 126", 128" with the spring elements 136 extending outward radially. Typically, there could be a total of up to one hundred eighty or less spring elements 136. The spring elements 136 elastically deform as the as the first and second fluoropolymer coatings 122, 124 slide relative to each other in response to an impact. Then after an impact the spring elements 136 return the first and second foam pads 110', 112' to their pre-impact relative position.

The subliner element of the third type 20 should be thick enough not to compress all the way to its full densification condition under a peak normal impact force which could easily reach, and possibly even exceed, a thousand pounds. Although the weight of a full helmet would likely be substantially less than that (being typically under five pounds), if all the helmet weight were to be required to be supported by the subliner element of the third type 20, with its high dynamic stiffness designed to accommodate a dynamic force of over a thousand pounds, the supporting area around point b for a static force of just five pounds could be so small that the supporting pressure could be uncomfortably high for the wearer were it not for the subliner elements of the second type 18, shown in third area C.

Subliner elements of the second type 18, located in third area C, would preferably be made of a much more compliant material than that used for the subliner element of the third type 20, preferably at least five times more compliant and perhaps more than an order of magnitude more compliant than the stiffer materials recommended for subliner element of the third type 20. Such a material could be an extra soft polyurethane foam such as LAST-A-FOAM®, EF-4003 by General Plastics Manufacturing Company, or EZ-Dri foam by Crest Foam Industries, both having, a relatively flat static and dynamic compression stress vs. deflection characteristic (the former 2.6 psi at 10%, 2.7 psi at 20%, 2.8 psi at 30%, 3.0 psi at 40%, and 3.4 psi at 50% and the latter 0.3 psi at 10%, 0.35 psi at 20%, 0.4 psi at 30%, 0.45 psi at 40% and 0.55 psi at 50%), so when incorporating the proper total area to accomplish the function of supporting the full weight or nearly the full weight of the helmet with the latter material enabling about five times the support area for extreme comfort, the exact location and thickness of the subliner elements of the second type 18 would not be that critical for the subliner elements of the second type 18 to be able to successfully support all, or almost all, of the weight of the helmet, yet contribute very little side force to the wearer's head 12 during an impact. However, the second type of subliner elements 18 are preferably positioned generally equidistantly about and between the first and third type of subliner elements 16, 20 in the third area C.

Figure 2A:
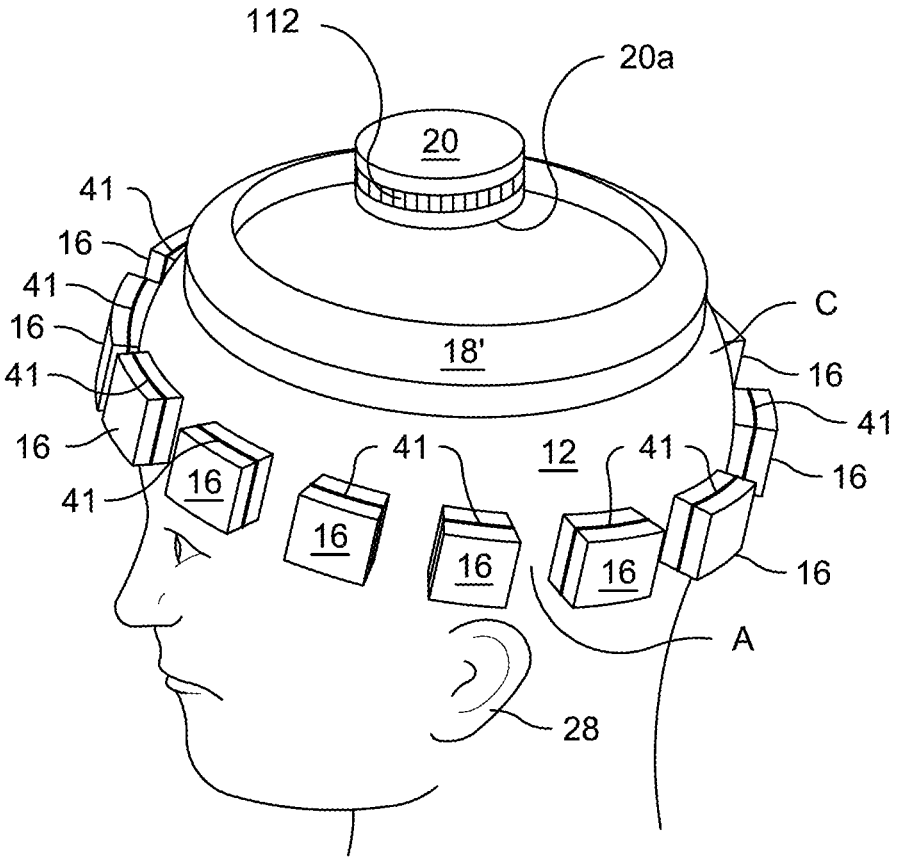
FIG. 2A is a perspective upper side view of a wearer's head showing the three types of subliner elements as they would be located in their respective designated areas, in accordance with a second embodiment of the present disclosure.

FIG. 2A shows a second embodiment of the present disclosure wherein there is at least one of a second type of subliner element 18. That is, instead of a plurality of the second type of subliner elements 18 as shown in FIG. 2, the second type of subliner elements 18 in accordance with the second embodiment are instead formed as a single annular ring 18'. Using a single annular ring 18' has the advantage of easier assembly and greater simplicity. Otherwise, all other elements of the subliner system 10 of the second embodiment are identical to the first embodiment.

FIG. 1 schematically shows the cervical spine 13 and its seven cervical vertebrae labeled Atlas (C1), Axis (C2), C3, C4, C5, C6 and C7. For both centered (directed toward the center of gravity of a wearer's head) and non-centered impacts having a large horizontal force component, almost all the side forces (and torques) that would be imparted to a wearer's head 12 during an impact would be imparted through the subliner elements of the first type 16, which would be located, or substantially located, in first area A and generally evenly distributed/spaced thereabout. First area A places the point of application of these impact forces as close as possible to the head's two natural pivot points for angular acceleration: a lower pivot point 12*a* where the C7 cervical vertebrae (which can be located by the prominent bone at the base of the back of the neck) meets the Ti thoracic vertebrae, and an upper pivot point 12*b* where the C1 cervical vertebrae (the atlas bone) meets the paired occipital condyle projections of the skull to enable forward and backward rotation (a "yes" motion) of the head and where the atlas bone meets the C2 cervical vertebrae (the axis bone) enabling axial rotation (a "no" motion) and side-to-side rotation of the head, this latter pivot being located approximately just above and slightly in front of the ear lobes. Thus, all the head angular accelerating torques imparted to the user's head during an impact would be kept as small as possible for a given force as a result of this lowest practical positioning of subliner elements of the first type 16.

As stated previously, each embodiment of the subliner element of the third type 20, due to its flat horizontal lower surface 20*a*, typically does not impart a significant horizontal force to the wearer's head 12. The following description of the first embodiment of the subliner element of the third type 20, is equally applicable to the second and third embodiments of the subliner element of the third type 20' 20". There may be certain impacts during which the lower surface 20*a* of the subliner element of the third type 20 would not remain flat but instead would tend to cup around the surface of the wearer's head 12. One such type of impact is obvious: a direct downward impact to the crown, or top, of the helmet 14, centered toward the center of gravity (e.g.) of the wearer's head 12. Although that type of impact would result in cupping the lower surface of subliner element of the third type 20 around the wearer's head 12, little or no horizontal force would be imparted to the wearer's head 12.

Another impact case that could cup the lower surface of the subliner element of the third type 20 might be a downward impact to the top of the helmet at a point located away from the crown and generally directed toward the body of the wearer. Picture a running back diving over the goal line, his helmet getting struck in midair by the shoulder pad of a linebacker diving the other way to stop him. Here, in addition to a significant downward force through the subliner element of the third type 20 (downward here meaning downward toward the body of the running back), there could be a not-insignificant horizontal force (horizontal here meaning horizontal relative to the body of the running back) imparted to the running back's head through subliner element of the third type 20, as well as through the subliner elements of the first type 16; for the most part the former would tend to rotate point b on the running back's head about the aforementioned upper pivot point toward the impact location, while the latter would tend to rotate point b about the aforementioned lower pivot point away from the impact location. So even in this case where the subliner element of the third type 20 cannot avoid imparting a horizontal (sideways) force, the structure of the total subliner system 10 still tends to cancel the above two rotational head motions and thereby reduce the resultant angular acceleration of the wearer's head 12.

Further reductions of imparted torque levels can be achieved by lowering the impact force levels, which can be accomplished by a proper choice of material for the subliner elements of the first type 16, and by including specific structural features in the subliner elements of the first type 16. Especially during an impact involving mostly a horizontal force component, only about one third of the subliner elements of the first type 16 (those located in the wide general region beneath the impact point) would be imparting most of the side normal force and side tangential force to the wearer's head 12 since the remaining subliner elements of the first type 16 would have tended to move away from the wearer's head 12 during the impact as the force-imparting subliner elements of the first type 16 compress and/or flex as a result of the high impact forces. The force levels could be of the same order of magnitude as those potentially experienced by the subliner element of the third type 20 (up to, and perhaps even more than a thousand pounds), and so the same energy absorbing viscoelastic foam materials cited for subliner element of the third type 20 would be in order for subliner elements of the first type 16, where their high energy absorption capability will help reduce the level of the high impact forces. The radial (thickness) dimension of the subliner elements of the first type 16 should be of sufficient length and have sufficient area to be able to avoid full densification at the maximum expected peak dynamic impact force, which could still be in the thousand-pound range for the total aggregate number of forces imparted on the subliner elements of the first type 16. On average the radial thickness of the subliner elements of the first type 16 would be approximately 0.25 to 1.25 inches, and preferably 0.75 inches in a two shell case, and approximately 1.0 to 2.0 inches, and preferably 1.5 inches in a single shell case.

In a preferred embodiment, to increase lateral compliance to help further reduce the imparted tangential side forces, the subliner elements of the first type 16 may be partitioned into multiple segments or columns which emanate in a substantially perpendicular direction from the inner surface 22 of the inner shell 24. The partitioning may be in the form of like-shaped segments having a particular cross-sectional shape, or it could be in the form of different shaped segments, as for instance an outer square cross-sectional shaped segment 36 having a centered circular cutout 38, along with a circular cross-sectional segment 40 to fill the circular cutout space, see FIG. 3. In order to best achieve the goal of reduced imparted side forces, the side surfaces of the partitioned side-by-side segments should be at least partially able to frictionally slide relative to each other in the segments' general radial direction. More particularly, double-sided nano tape 39 is preferably positioned between the nested side surfaces such that the side surfaces are in direct contacting engagement with the nano tape 39. Thus, when adjacent side surfaces slide relative to each other during an impact, the highly viscous nano tape gets sheared across its thickness and additional energy is absorbed. It will be understood by those skilled in the art that nano tape 39 may be any nano tape which is commercially available. In general, nano tape 39 is an elastic tape that includes a nanofiber or nanotube structure which adheres to an adjacent surface due to Van der Waals forces. In one embodiment, the nano tape 39 is a comprised of carbon nanotube arrays provided on a backing layer formed of a flexible polymer, such as polyurethane, with Van der Waals interactions occurring between the carbon nanotube arrays and individual nanotubes and the adjacent surface. The nano tape is in the range of 0.5 to 2.0 mm thick and most preferably 1.0 mm thick. To assemble the subliner element of the first type 16 shown in FIG. 3, the nano tape 39 is wrapped around the circular cross-sectional segment 40 which is then inserted into the circular cutout 38 such that that nano tape 39 is positioned therebetween, as described in more detail below. The segment's generally parallel partitioned surfaces cannot be exactly radial from the standpoint of the wearer's head 12 due to the width of the partitioned element, but they are substantially radial. The partitioning or segmenting might be implemented using a simple "cookie cutter" approach. Other examples of partitioning subliner elements that could be used for the first type of subliner element 16 are described below in FIGS. 7*a*-7*b* through 15*a*-15*b*. These and their subsets, are themselves a small subset of all of the partitioning configurations that may be utilized.

Figure 3:
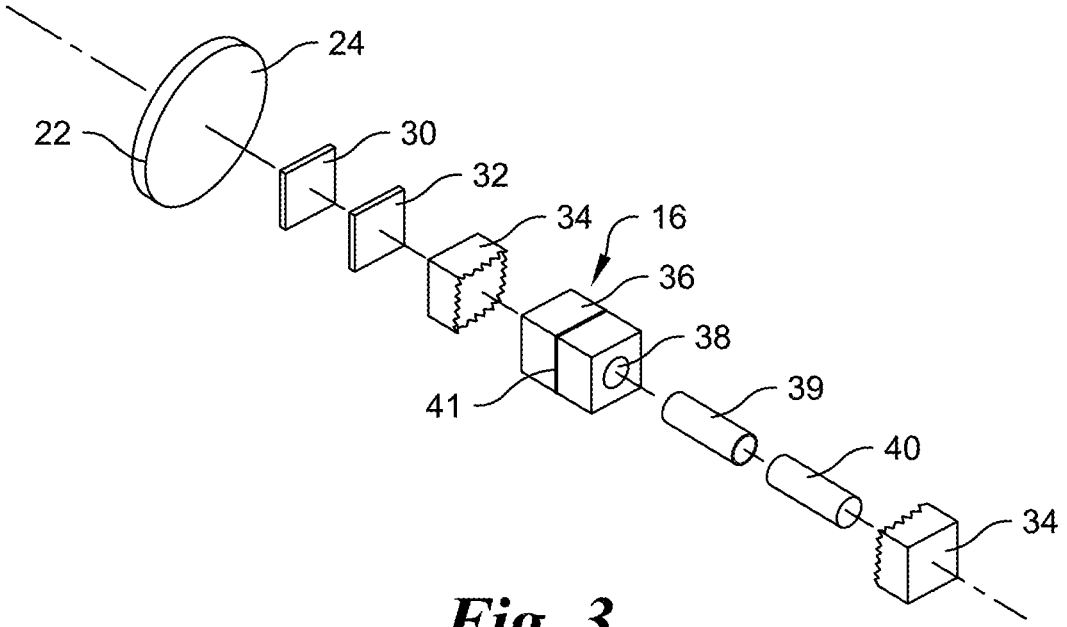
FIG. 3 is an exploded perspective view of a partitioned subliner element and its attachment to a portion of the inner shell, showing the portion of the inner shell, the hook part and the loop part of a hook and loop fastener mechanism, the partitioned segments, and an optional covering.

FIG. 3 is an exploded perspective view of a partitioned subliner element of the first type 16 and its attachment to a portion of the inner surface 22 of the inner shell 24, showing the portion of the inner shell 24, the hook part 30 and the loop part 32 of a hook and loop fastener mechanism of a type in common usage today for such applications, along with an optional covering 34 over the subliner element of the first type 16. Any of the subliner elements, of any of the three subliner element types 16, 18, 20 may include a full covering 34 formed from a fabric or a film 34 to improve the comfort of the wearer, to improve the durability of the subliner element types 16, 18, 20, or to improve the functioning of the subliner element types 16, 18, 20, the latter possibly including, but not being limited to, its ability hold partitioned columns of a subliner element type 16, 18, 20 in place, its ability to protect against moisture and contaminants, its ability to improve air flow, and its ability to improve moisture dissipation. The optional covering 34 need not be full as shown but may be partial if the circumstances warrant. The fabric of choice may be any of a wide range of suitable fabrics, while the film of choice could be any suitable polymer or elastomer film having a suitable thickness for the application.

Referring still to FIG. 3, the subliner element of the first type 16 preferably includes a generally inelastic cord 41 surrounding the subliner element of the first type 16. The subliner element of the first type 16 has a length extending away from the inner surface 22. The inelastic cord 41 is positioned generally in the middle of the length. The inelastic cord 41 is preferably constructed of KEVLAR®, but other like materials could be substituted. The purpose of the inelastic cord 41 is to prevent the subliner element of the first type 16 from bulging in the center area to ensure that the circular cross-sectional segment 40 and the centered circular cutout 38 maintain good surface to surface contact with the nano tape 39. While the inelastic cord 41 is shown being positioned directly around the outer square shaped the segment 36, it could also be positioned about the cover 34.

FIG. 4 is a cross-sectional side view located at the midsagittal plane of the wearer's head 12 showing the three types of subliner elements 16, 18, 20 as located in FIG. 2 and the inner shell 24 to which they are attached. The inner shell 24 may be part of a single liner, single shell helmet 14 as illustrated in the figure, or it may be part of a multiple liner, multiple shell helmet, as discussed in more detail below. The relative size of the inner shell 24 shown in FIG. 4 at the lower end of the indicated radial thickness range would be consistent with the former case if the helmet were for example an equestrian helmet or a ski helmet, and the relative size of the inner shell shown in FIG. 4 would also be consistent with the latter case if the helmet were for example a football helmet or a motorcycle helmet. A football helmet or a motorcycle helmet of the single liner, single shell type would typically have a larger subliner system 10 at the higher end of the indicated radial thickness range, which in that case would also be the outer shell. Thus, in a football helmet or motorcycle helmet of the single liner, single shell type embodiment, the radial spacing of the inner shell 24 from the head 12 would typically be greater than that shown in FIG. 4 and the subliner elements of the first, second and third types 16, 18, 20 would accordingly have a greater radial dimension.

With continued reference to FIG. 4, the inner surface 22 of the inner shell 24 above subliner element of the third type 20 is shown to have a flat horizontal surface 42 rather than a concave surface. The inner shell 24 may be molded that way to achieve the flat horizontal surface 42. The flat horizontal surface 42 is not absolutely necessary but it is preferred to enable subliner element of the third type 20 to be flat on its upper surface as well as its lower surface 20*a*, which helps to assure a horizontal lower surface 20*a*, and makes it simpler and more controllable to determine, select, and properly align and apply a proper thickness subliner element of the third type 20 so that it's lower surface 20*a* remains horizontal and preferably barely touches the wearer's head 12. As shown in FIG. 4, the two cross-sectioned subliner elements of the second type 18 are shown in the third area C, properly radially compressed, as would be all of the other subliner elements of the second type 18 not shown in the cross-section, when all are supporting the full weight of the helmet, even though the full helmet with all its potential parts, including a potential face guard and a potential chin strap or jaw strap system, is not shown in FIG. 4. Finally, the subliner elements of the first type 16 in the first area A each have a thickness to yield a snug but not uncomfortable fit with the wearer's head 12.

Figure 5:
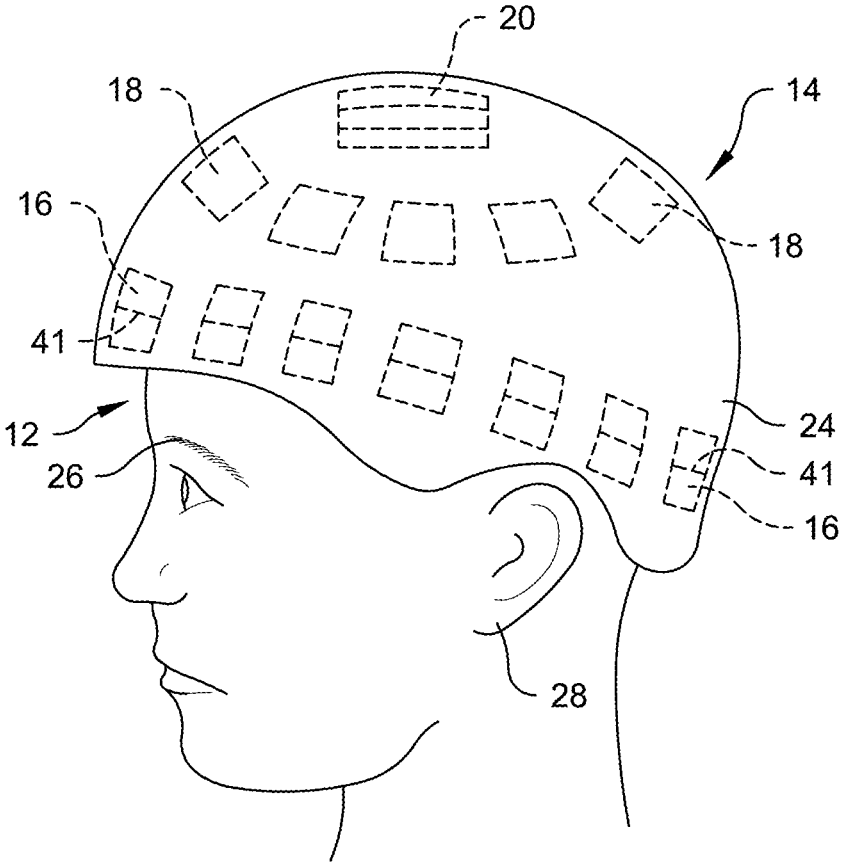
FIG. 5 is a left side elevational view showing the inner shell of FIG. 4 positioned on a wearer's head.

FIG. 5 is a left side elevational view of the wearer's head 12 showing the inner shell 24 of FIG. 4 located over the wearer's head 12 with all the subliner elements of the first, second and third type 16, 18, 20 positioned as shown in phantom and as in FIG. 2; all of the subliner elements of the first, second and third type 16, 18, 20 being attached to the inner surface 22 of the inner shell 24, typically by the easy-on, easy-off, hook and loop fastener mechanism 30, 32 shown in FIG. 3. The easy-on, easy-off capability helps in being able to customize the helmet for an individual wearer. The potential materials to be used for the inner shell 24 would depend upon which embodiment it is being used in. In the single liner, single shell helmet embodiment the inner shell 24 (which is now also the outer shell) must be able to handle a direct impact, so an impact resistant material such as polycarbonate or high impact ABS would be appropriate. In the multiple liner, multiple shell helmet embodiment described in more detail below, the inner shell 24 need not handle a direct impact, but it still would need to be able to handle high forces so a high strength polymer composite containing either glass fibers, carbon fibers, or KEVLAR® fibers (commonly understood as heat-resistant and strong synthetic fibers) or a composite utilizing a combination of different fibers could be appropriate. Also, for this embodiment, the inner shell 24 could be constructed of a thin metal, such as stainless steel or an aluminum alloy (either perforated, or not perforated), and in large quantities could be fabricated by pressing it to shape in a die with a large machine press. Such a thin metal shell, perhaps a thirty-second of an inch or less in thickness, could weigh even less than a comparable strength polymer composite shell.

Figure 6:
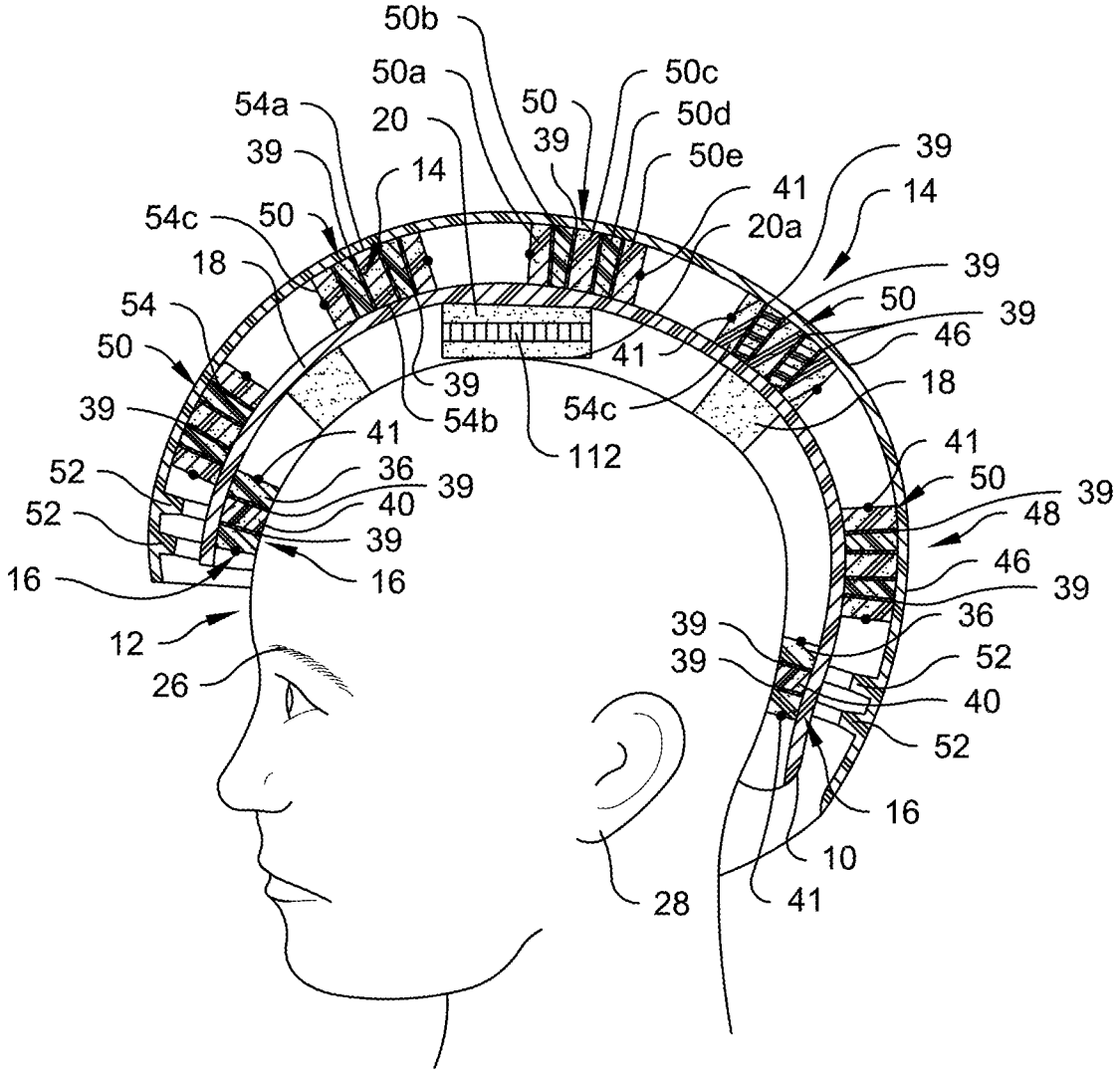
FIG. 6 is a cross-sectional side view at the midsagittal plane of a wearer's head, of a two liner, two shell helmet embodiment, where the subliner elements and the inner shell shown in FIG. 4 and FIG. 5 make up a subliner system, to which is added a second liner and an outer shell, the second liner being attached to both the inner shell and the outer shell in accordance with the present disclosure.

FIG. 6 is a cross-sectional side view located at the midsagittal plane of a wearer's head 12, showing a two liner, two shell, helmet 14 embodiment of the present disclosure. FIG. 6 shows the subliner system 10 of FIG. 4, plus a second or outer liner 44 and a second or outer shell 46 which together form an outer shell system 48. Five outer liner elements 50 are shown in the second liner 44 because they cross the midsagittal plane. Typically, there may be ten to fifteen additional liner elements 50 in the second liner 44 which are not shown in FIG. 6 because they do not cross the midsagittal plane. That would add up to a likely total of fifteen to twenty total liner elements 50 in the second liner 44, spread out more or less equidistantly throughout the available space between the inner shell 24 and the second or outer shell 46.

All the liner elements 50 of the second liner 44 are firmly attached to both the outer surface of the inner shell 24 and the inner surface of the outer shell 46. By contrast, subliner elements of the first, second and third types, 16, 18, 20 in the subliner system 10 can only be attached to the inner shell 24 (they cannot be attached to a wearer's head). The firm attachment of the liner elements 50 of the second liner 44 to both the inner and outer shells 24, 46 enables liner elements 50 to experience not just high compression forces, but high shear forces and high tensile forces as well. As a result, the attachment requirement here is beyond the capability of a standard hook and loop fastener and is more in the realm of a high strength, wide temperature range, flexible adhesive, such as LOCTITE® 4902, or LOCTITE® Plastic Bonder, both by Henkel Corporation. The former is a one-part adhesive, the latter a two-part adhesive, and both are quick curing.

These flexible, high strength attachments make it possible for all the liner elements 50 of the second liner 44 to participate in mitigating any impact to the wearer's head 12, regardless of the impact's location or direction. That mitigation is accomplished through the widespread positioning of the liner elements 50 and their ability to efficiently absorb energy in three different modes: compression, shear, and tension. For example, for any centered impact the liner elements 50 of the second liner 44 generally located in the region beneath the impact will experience compression, those located to the side of the impact will experience shear, and those located opposite the impact will experience tension, while those located in between will experience some combination of compression, shear, and tension. For any non-centered impact most of the liner elements 50 of the second liner 44 will experience a higher degree of shear. Because every impact is different in its location and direction, each liner element 50 in the second liner 44 must be able to absorb energy at all the expected possible levels of compression, shear, and tension, and combinations thereof.

Furthermore, in order to even be in a position of optimally absorbing energy, each liner element 50 of the second liner 44 must become deformed during an impact to its full extent by the outer shell 46, not just those liner elements 50 beneath the impact, but those to the side of the impact, and those opposite the impact as well, and the outer shell 46 must remain rigid enough during the impact to be able to accomplish that. Because the outer shell 46 is relatively thin and typically made of a polycarbonate or high impact ABS, this requires that the outer shell 46 be rigidized, especially near its opening to accommodate a wearer's head 12, which is the place where it is the weakest. Notice in the figure, that there are two molded-in internal rings 52 near the opening to accomplish the rigidizing, but other rigidizing approaches such as severe contouring or metal banding (not shown) would also be acceptable.

Achieving the optimum energy absorption by all the liner elements 50 of the second liner 44 also requires they be fabricated of a material having an inherent high energy absorbing capability, and that the material also have a proper level of dynamic stiffness for the total second liner element 50 footprint area. To meet these criteria, the liner elements 50 of the second liner 44 may be fabricated from the same list of materials recommended for subliner elements of the first and third types 16, 20, the list including: a vinyl nitrile foam such as IMPAX® VN600, VN740, or VN1000 by Dertex Corporation, or a polyurethane foam such as LAST-A-FOAM® FP 8015 by General Plastics Manufacturing Company. However, in block form, each material likely presents too much dynamic stiffness in shear as compared to its dynamic stiffness in compression and tension. So to reduce a second liner element's dynamic stiffness in shear, without at the same time reducing its dynamic stiffness in compression or tension, partitioning of each liner element 50 into discrete adjacent segments is preferred, somewhat similar to what has been previously discussed for subliner elements of the first type 16, but even more so for the second liner elements 50 because the potential shear levels experienced by the second liner elements 50 are greater.

The cross-sectioning of the second liner elements 50 in FIG. 6 reveals each element to be partitioned into five equal segments 50*a*, 50*b*, 50*c*, 50*d*, 50*e*. However, one skilled in the art will understand that there are several partitioning possibilities, all of which could be acceptable options if they can achieve the proper level of reduction in the total shear force as compared to the total compression and tensile forces.

Figure 7A:
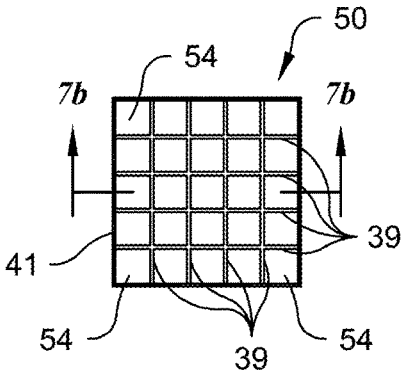
FIG. 7*a* illustrates, in top plan view, a first partitioning arrangement for the second liner elements of FIG. 6.
Figure 8A:
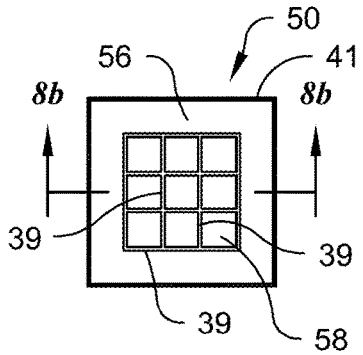
FIG. 8*a* illustrates, in top plan view, a second partitioning arrangement for the second liner elements of FIG. 6.
Figure 9A:
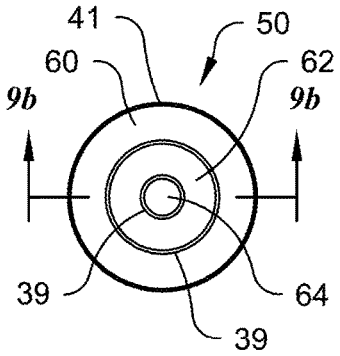
FIG. 9*a* illustrates, in top plan view, a third partitioning arrangement for the second liner elements of FIG. 6.
Figure 10A:
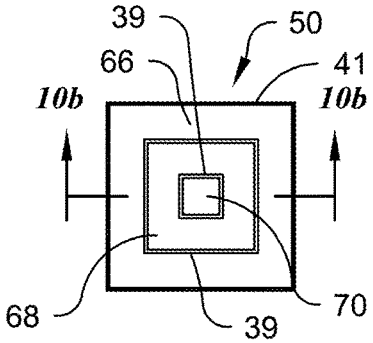
FIG. 10*a* illustrates, in top plan view, a fourth partitioning arrangement for the second liner elements of FIG. 6.
Figure 11A:
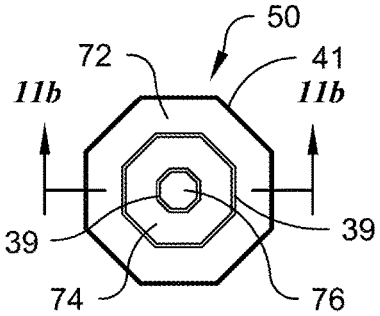
FIG. 11*a* illustrates, in top plan view, a fifth partitioning arrangement for the second liner elements of FIG. 6.
Figure 12A:
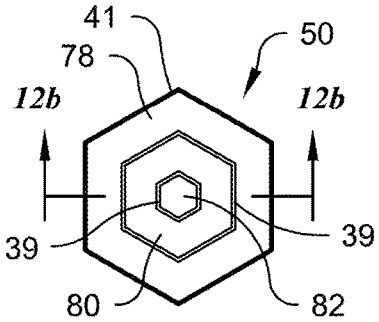
FIG. 12*a* illustrates, in top plan view, a sixth partitioning arrangement for the second liner elements of FIG. 6.
Figure 13A:
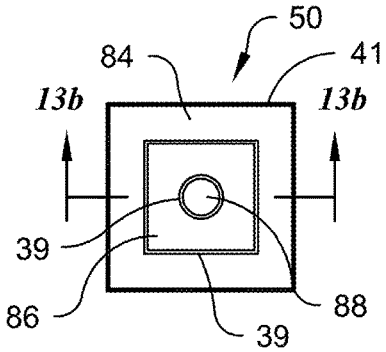
FIG. 13*a* illustrates, in top plan view, a seventh partitioning arrangement for the second liner elements of FIG. 6.
Figure 14A:
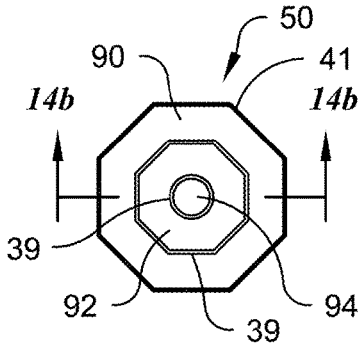
FIG. 14*a* illustrates, in top plan view, an eighth partitioning arrangement for the second liner elements of FIG. 6.
Figure 15A:
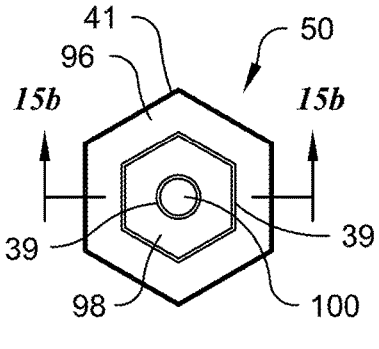
FIG. 15*a* illustrates, in top plan view, a ninth partitioning arrangement for the second liner elements of FIG. 6.

FIGS. 7*a* through 15*a* show nine such partitioning possibilities, illustrated in plan view (from the viewpoint of the outer shell 46) to be able to see what they actually could represent. Cross-sectional views in FIGS. 7*b* through 15*b* show the same sectional view as what is shown in FIG. 6. However, even these nine are still an extremely reduced sample of what may be possibly used as partitioning arrangements for the second liner elements 50. FIGS. 7*a* and 7*b* show twenty-five equal square shaped segments or foam columns 54 arranged in a 5×5 square array. That is, the foam columns 54 form a plurality of generally radially oriented side-by-side flexible individual and independent foam columns or segments 54. The columns or segments 54 are preferably formed entirely of foam and having a top surface 54*a*, a bottom surface 54*b*, and foam side surfaces 54*c* where the top surface 54*a* is directly attached to the inner surface of the outer shell 48 and the bottom surface is directly attached to the outer surface of the inner shell 24. The foam side surfaces 54*c* of adjacent columns or segments 54 are positioned side-by-side with respect to each other preferably with double-sided nano tape 39 positioned therebetween such that the segments 54 are nested in slidable direct contacting frictional engagement with the nano tape 39. FIGS. 8*a* and 8*b* show a liner element 50 having an outer circumferential square wall 56 and an inner square cutout 58, filled with nine equal square shaped segments arranged in a 3×3 square array. Nano tape 39 is positioned between the outer circumferential square wall 56 and the nine equal square shaped segments as well as between the nine equal square shaped segments themselves. FIGS. 9*a* and 9*b* show a liner element 50 having an outer annular wall 60, an inner annular wall 62 complementarily positioned in the outer annular wall 60 and an innermost cylinder 64 complementarily positioned within the inner annular wall 62. Nano tape 39 is positioned between the outer annular wall 60, the inner annular wall 62 and the innermost cylinder 64. FIGS. 10*a* and 10*b* show a liner element 50 having a square outer annular wall 66, a square inner annular wall 68 complementarily positioned in the square outer annular wall 66 and an innermost generally square in cross section cylinder 70 complementarily positioned within the square inner annular wall 68. Nano tape 39 is positioned between the square outer annular wall 66, the square inner annular wall 68 and the innermost generally square in cross section cylinder 70. FIGS. 11*a* and 11*b* show a liner element 50 having octagonal outer annular wall 72, an octagonal inner annular wall 74 complementarily positioned in the octagonal outer annular wall 72 and an innermost generally octagonal in cross section cylinder 76 complementarily positioned within the octagonal inner annular wall 74. Nano tape 39 is positioned between the octagon all outer annular wall 72, the octagon oh inner annular wall 74 and the innermost generally octagonal in cross section cylinder 76. FIGS. 12*a* and 12*b* show a liner element 50 having a hexagonal outer annular wall 78, a hexagonal inner annular wall 80 complementarily positioned in the hexagonal outer annular wall 78 and an innermost generally hexagonal in cross section cylinder 82 complementarily positioned within the hexagonal inner annular wall 80. Nano tape 39 is positioned between the hexagonal outer annular wall 78, the hexagonal inner annular wall 80, and the innermost generally hexagonal in cross section cylinder 82. FIGS. 13*a* and 13*b* show a liner element 50 having square outer annular wall 84, a square inner annular wall 86 complementarily positioned in the square outer annular wall 84 and an innermost generally circular in cross section cylinder 88 complementarily positioned within the square inner annular wall 86. Nano tape 39 is positioned between the square outer annular wall 84, the square inner annular wall 86 and the innermost generally circular in cross section cylinder 88. FIGS. 14*a* and 14*b* show a liner element 50 having octagonal outer annular wall 90, an octagonal inner annular wall 92 complementarily positioned in the octagonal outer annular wall 90 and an innermost generally circular in cross section cylinder 94 complementarily positioned within the octagonal inner annular wall 92. Nano tape 39 is positioned between the octagon all outer annular wall 90, the octagon oh inner annular wall 92 and the innermost generally circular in cross section cylinder 94. FIGS. 15*a* and 15*b* show a liner element 50 having a hexagonal outer annular wall 96, a hexagonal inner annular wall 98 complementarily positioned in the hexagonal outer annular wall 96 and an innermost generally circular in cross section cylinder 100 complementarily positioned within the hexagonal inner annular wall 98. Nano tape 39 is positioned between the hexagonal outer annular wall 96, the hexagonal inner annular wall 98 and the innermost generally circular in cross section cylinder 100.

Figure 7B:
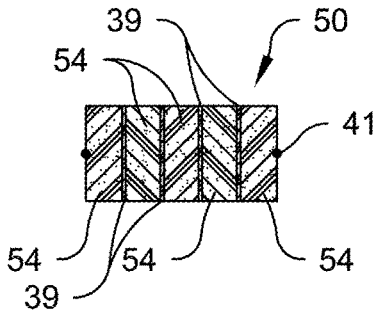
FIG. 7*b* is a cross-sectional view of FIG. 7*a* taken along line 7*b*-7*b*.
Figure 8B:
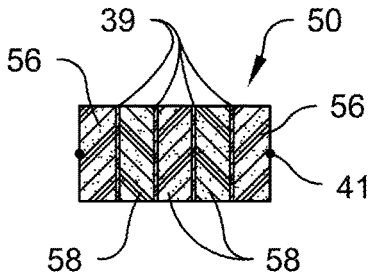
FIG. 8*b* is a cross-sectional view of FIG. 8*a* taken along line 8*b*-8*b*.
Figure 9B:
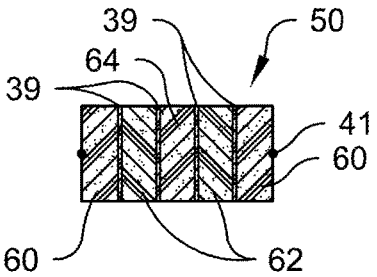
FIG. 9*b* is a cross-sectional view of FIG. 9*a* taken along line 9*b*-9*b*.
Figure 10B:
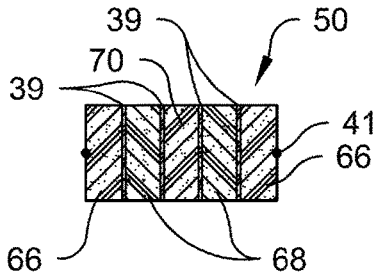
FIG. 10*b* is a cross-sectional view of FIG. 10*a* taken along line 10*b*-10*b*.
Figure 11B:
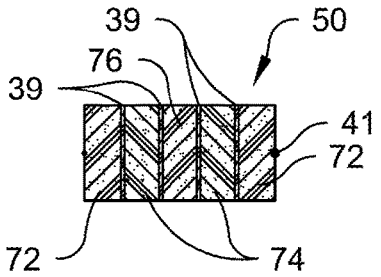
FIG. 11*b* is a cross-sectional view of FIG. 11*a* taken along line 11*b*-11*b*.
Figure 12B:
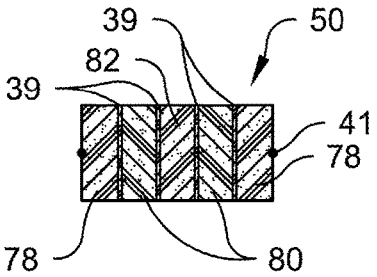
FIG. 12*b* is a cross-sectional view of FIG. 12*a* taken along line 12*b*-12*b*.
Figure 13B:
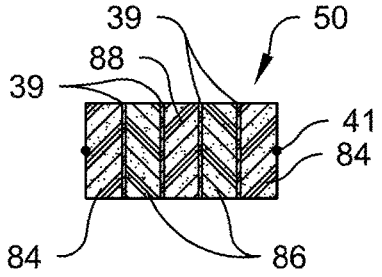
FIG. 13*b* is a cross-sectional view of FIG. 13*a* taken along line 13*b*-13*b*.
Figure 14B:
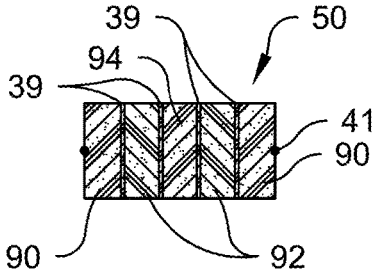
FIG. 14*b* is a cross-sectional view of FIG. 14*a* taken along line 14*b*-14*b*.
Figure 15B:
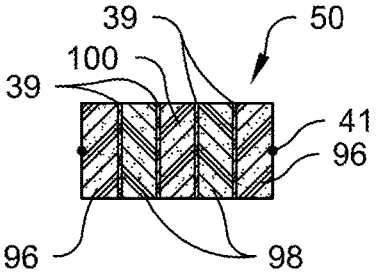
FIG. 15*b* is a cross-sectional view of FIG. 15*a* taken along line 15*b*-15*b*.

FIGS. 7*a* and 7*b* show a specific case of the general class of a radially partitioned second liner element 50 into side-by-side segments. FIGS. 8*a* and 8*b* through FIGS. 15*a* and 15*b* show specific cases of the general class of radially partitioned second liner elements 50 into nesting and nested segments. Note that some segments can be both nesting and nested. Also note FIG. 3 shows an example of a nesting and nested segmented element, although not a second liner element 50 but a subliner element of the first type 16.

In general, the segment boundaries of the liner elements 50 (all formable by a "cookie cutter type slicer") would be oriented in a substantially radial direction (from the standpoint of the wearer's head 12, or the outer shell 46, etc.) but most can never be oriented exactly in the radial direction, in part due to the extended width dimensions of a liner elements 50. Nevertheless, for simplification purposes, this specification will still be referred to them as "radial." During an impact that results in a shearing motion of the liner elements 50, at least some of the adjacent segment surfaces may move relative to each other along their boundaries where the nano tape 39 is located in the radial direction to form S curves (not shown), and through dynamic friction to thereby provide some additional energy absorption. The use of the nano tape 39 increases the dynamic friction between adjacent moving segments resulting in greater energy absorption. The concept of absorbing energy through adjacent surfaces moving relative to each other to form S curves is fully described in U.S. Pat. No. 9,032,558 but without nano tape, which is hereby incorporated by reference in its entirety. The addition of nano tape results in greater energy absorption and is thus an improvement.

Figure 16:
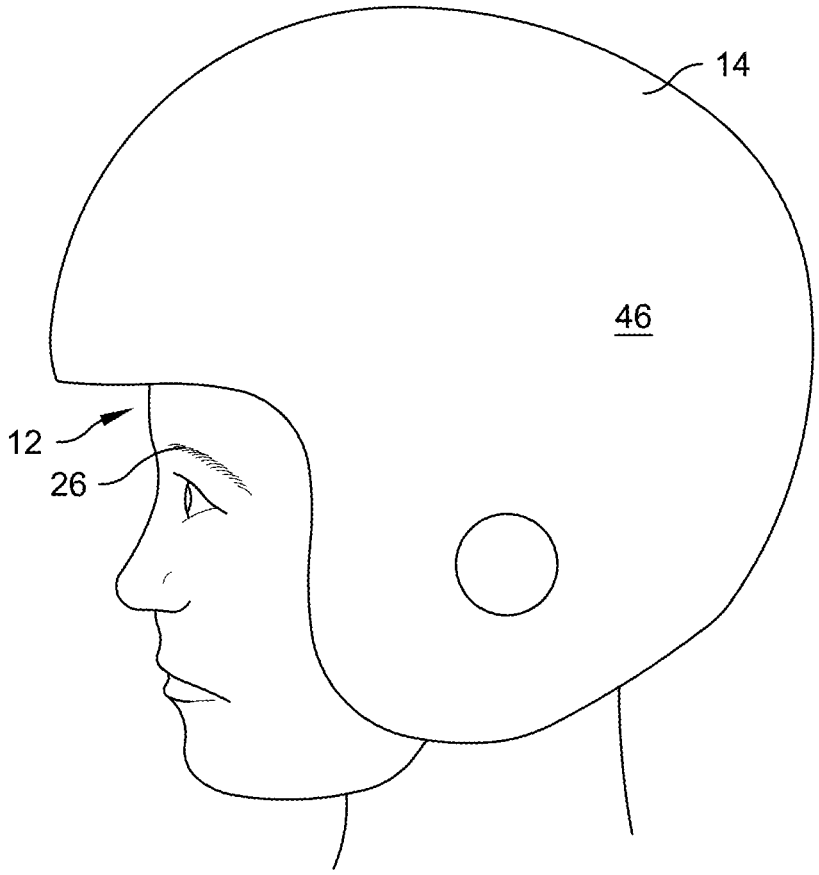
FIG. 16 is a left side elevational view showing the outer shell of FIG. 6 positioned on a wearer's head.

FIG. 16 illustrates a left side elevational view showing the outer shell 46 of FIG. 6 positioned on a wearer's head 12. The size and shape of the outer shell 46 might be typical of a football helmet.

Figure 17:
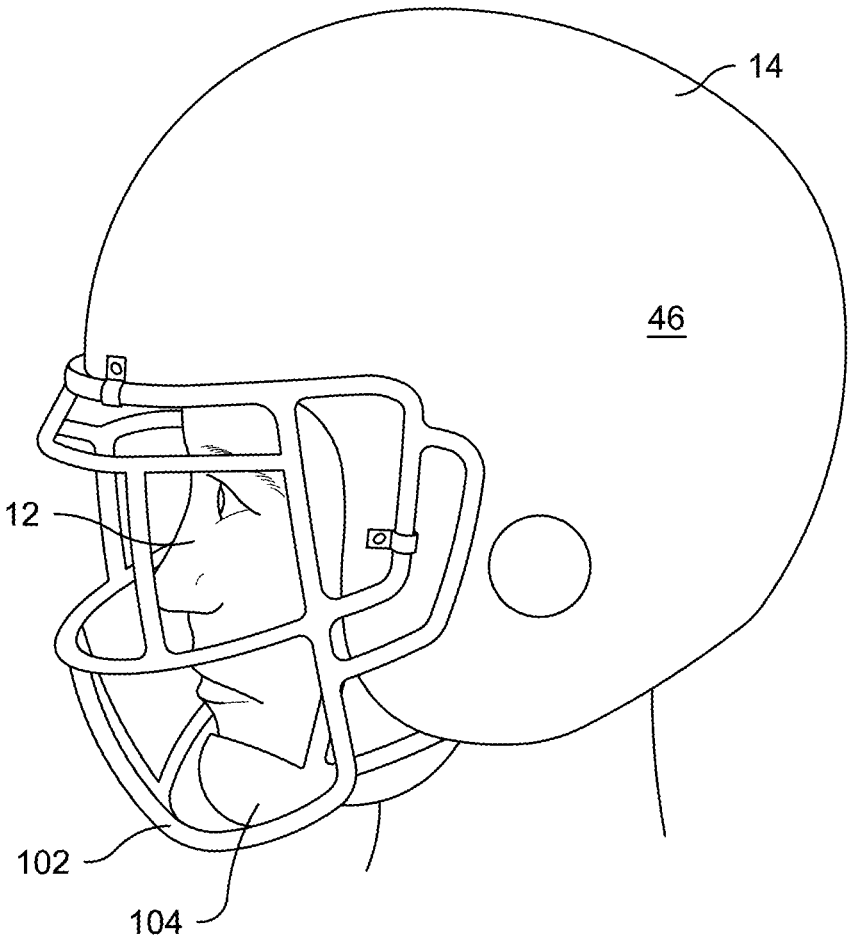
FIG. 17 is a left side elevational view of a wearer's head showing a face guard attached to the outer shell of FIG. 16, and a chin strap positioned on the wearer's chin and attached to the inner shell of FIG. 5.

FIG. 17 is a left side elevational view of a wearer's head 12 showing a face guard 102 attached to the outer shell 46 of FIG. 8, and a chin strap 104 positioned on the wearer's chin and attached to the inner shell 24 of FIG. 5, both typical of a football helmet application.

Finally, although only a first preferred embodiment having a subliner system 10, and a second preferred embodiment having a subliner system 10 and an outer shell system 48 have been described in significant detail, the addition of a third liner and a third shell (not shown) would still be within the scope of the present disclosure. It will also be appreciated by those skilled in the art that changes, or modifications could be made to the above described embodiments without departing from the broad inventive concepts of the disclosure. Therefore, it should be appreciated that the present disclosure is not limited to the particular use or particular embodiments disclosed but is intended to cover all uses and all embodiments within the scope or spirit of the described disclosure.

I claim:

1. A helmet adapted to be worn on a head of a wearer, the head having a top area centered about a top of the wearer's head encompassing approximately 0.44 to 7 square inches, the helmet comprising:

a subliner shell comprised of a hard impact resistant material, the shell having inner and outer surfaces, the shell adapted to surround at least a portion of the cranial part of the wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

at least one subliner element extending from the inner surface of the shell at a location such that the subliner element is adapted to be aligned with the top area when the helmet is worn, the at least one subliner element comprising:

a first foam pad constructed of an energy absorbing viscoelastic foam material having a top surface and a bottom surface, the top surface being attached to the inner surface of the shell, a second foam pad being constructed of an energy absorbing viscoelastic foam material, the second foam pad being radially partitioned into individual and independent segments, the independent segments are nested with respect to each other such that the nested segments have side surfaces in slidable direct contacting engagement with side surfaces of adjacent nested segments, the second foam pad having a top surface attached to the bottom surface of the first foam pad, and a third foam pad constructed of an energy absorbing viscoelastic foam material having a top surface and a bottom surface, the top surface of the third foam pad being attached to the bottom surface of the second foam pad, the bottom surface of the third foam pad being a substantially flat surface which is substantially tangent to the surface of the wearer's head beneath it when the helmet is worn.

2. The helmet as recited in claim 1, further including a generally inelastic cord surrounding the second foam pad.

3. The helmet as recited in claim 2, wherein the second foam pad has a length and the cord is positioned generally in the middle of the length.

4. The helmet as recited in claim 3, wherein the cord is constructed of synthetic fiber.

5. The helmet as recited in claim 1, wherein the first, second and third foam pads are comprised of an energy absorbing viscoelastic foam material capable of exhibiting a compressive stress of at least 50 psi for a dynamic compression of 50%.

6. A helmet adapted to be worn on a head of a wearer, the head having a pair of eyebrows and a pair of ears, the head having an annular headband shaped area encircling the wearer's head, the headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head, a top area centered about a top of the wearer's head encompassing approximately 0.44 to 7 square inches, and a middle area of the head defined between the headband area and the top area, the helmet comprising:

a subliner shell comprised of a hard impact resistant material, the shell having inner and outer surfaces, the shell adapted to surround at least a portion of the cranial part of the wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

a plurality of a first type of subliner elements extending from the inner surface of the shell at a location such that the first type of subliner elements are adapted to be aligned with the headband area when the helmet is worn, the first type of subliner elements being constructed of an energy absorbing viscoelastic foam material;

at least one of a second type of subliner element extending from the inner surface of the shell at a location such that the at least one of the second type of subliner element is adapted to be aligned with the middle area when the helmet is worn, the at least one of the second type of subliner element being constructed of a foam material; and a third type of subliner element extending from the inner surface of the shell at a location such that the third type of subliner element is adapted to be aligned with the top area when the helmet is worn, the third type of subliner element comprising:

a first foam pad constructed of an energy absorbing viscoelastic foam material having a top surface and a bottom surface, the top surface being attached to the inner surface of the shell, a second foam pad being constructed of an energy absorbing viscoelastic foam material, the second foam pad being radially partitioned into individual and independent segments, the independent segments are nested with respect to each other such that the nested segments have side surfaces in slidable direct contacting engagement with side surfaces of adjacent nested segments, the second foam pad having a top surface attached to the bottom surface of the first foam pad, and a third foam pad constructed of an energy absorbing viscoelastic foam material having a top surface and a bottom surface, the top surface of the third foam pad being attached to the bottom surface of the second foam pad, the bottom surface of the third foam pad being substantially flat surface which is substantially tangent to the surface of the wearer's head beneath it when the helmet is worn, the at least one of the second type of subliner element being positioned between the plurality of the first type of subliner elements and the third type of subliner element.

7. The helmet as recited in claim 6, further including a generally inelastic cord surrounding the second foam pad.

8. The helmet as recited in claim 7, wherein the second foam pad has a length and the cord is positioned generally in the middle of the length.

9. The helmet as recited in claim 8, wherein the cord is constructed of synthetic fiber.

10. The helmet as recited in claim 6, wherein the first, second and third foam pads are comprised of an energy absorbing viscoelastic foam material capable of exhibiting a compressive stress of at least 50 psi for a dynamic compression of 50%.

11. The helmet as recited in claim 6 further comprising:

an outer shell comprised of a hard impact resistant material, the outer shell having inner and outer surfaces, the outer shell surrounding at least a portion of the subliner shell, the inner surface of the outer shell being spaced from the outer surface of the subliner shell at an initial pre-impact relative position; and a plurality of outer liner elements located in the space between the outer surface of the subliner shell and the inner surface of the outer shell and attached to both the outer surface of the subliner shell and the inner surface of the outer shell wherein at least one of the outer liner elements is comprised of an energy absorbing viscoelastic foam.

12. The helmet as recited in claim 11 the outer liner elements being radially partitioned into individual and independent segments, the independent segments are nested with respect to each other with double-sided nano tape positioned therebetween such that the nested segments have side surfaces in direct contacting engagement with the nano tape.

13. The helmet as recited in claim 6 wherein the first type of subliner elements are radially partitioned into individual and independent segments, the independent segments are nested with respect to each other with double-sided nano tape positioned therebetween such that the nested segments have side surfaces in direct contacting engagement with the nano tape.

14. The helmet as recited in claim 6, wherein the headband area is approximately 1 inch wide and the plurality of first type of subliner elements are adapted to be located to overlap the width of the headband area.

15. A helmet adapted to be worn on a head of a wearer, the head having a top area centered about a top of the wearer's head encompassing approximately 0.44 to 7 square inches, the helmet comprising:

a subliner shell comprised of a hard impact resistant material, the shell having inner and outer surfaces, the shell adapted to surround at least a portion of the cranial part of wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

at least one subliner element extending from the inner surface of the shell at a location such that the subliner element is adapted to be aligned with the top area when the helmet is worn, the at least one subliner element comprising:

a first foam pad constructed of an energy absorbing viscoelastic foam material having a top surface and a bottom surface, the top surface being attached to the inner surface of the shell, the bottom surface being generally planar and having a first fluoropolymer coating adhered thereto; and a second foam pad constructed of an energy absorbing viscoelastic foam material having a top surface and a bottom surface, the top surface of the second foam pad being generally planar and having a second fluoropolymer coating adhered thereto, the first and second foam pads being positioned with the first and second fluoropolymer coatings being in sliding facing engagement, the bottom surface of the second foam pad being a substantially flat surface which is substantially tangent to the surface of the wearer's head beneath it when the helmet is worn.

16. The helmet as recited in claim 15, wherein the first and second fluoropolymer coatings are biased toward each other by a force applied to the first and second foam pads.

17. The helmet as recited in claim 15, wherein the first foam pad has a first side surface extending between the top and bottom surfaces thereof, the second foam pad has a second side surface extending between the top and bottom surfaces thereof, a first rib secured to the first side surface, a second rib secured to a second side surface and a biasing element extending between the first and second ribs to force the first and second fluoropolymer coatings toward each other.

18. The helmet as recited in claim 15, wherein the first and second foam pads are comprised of an energy absorbing viscoelastic foam material capable of exhibiting a compressive stress of at least 50 psi for a dynamic compression of 50%.

19. A helmet adapted to be worn on a head of a wearer, the head having a pair of eyebrows and a pair of ears, the head having an annular headband shaped area encircling the wearer's head, the headband shaped area being approximately 0.75 to 1.25 inches wide and having a lower edge defining a plane positioned approximately 0.5 to 1.5 inches above the eyebrows and approximately 0.25 to 0.75 inches above an upper junction of the ears and the wearer's head, a top area centered about a top of the wearer's head encompassing approximately 0.44 to 7 square inches, and a middle area of the head defined between the headband area and the top area, the helmet comprising:

a subliner shell comprised of a hard impact resistant material, the shell having inner and outer surfaces, the shell adapted to surround at least a portion of the cranial part of wearer's head with the inner surface of the shell being spaced from the wearer's head at an initial pre-impact relative position when the helmet is worn; and a subliner, at least a part of which is adapted to be in contact with the wearer's head when the helmet is worn prior to an impact and during an impact, the subliner comprising:

a plurality of a first type of subliner elements extending from the inner surface of the shell at a location such that the first type of subliner elements are adapted to be aligned with the headband area when the helmet is worn, the first type of subliner elements being constructed of an energy absorbing viscoelastic foam material;

at least one of a second type of subliner element extending from the inner surface of the shell at a location such that the at least one of the second type of subliner element is adapted to be aligned with the middle area when the helmet is worn, the at least one of the second type of subliner element being constructed of a foam material; and a third type of subliner element extending from the inner surface of the shell at a location such that the third type of subliner element is adapted to be aligned with the top area when the helmet is worn, the third type of subliner element comprising:

a first foam pad constructed of an energy absorbing viscoelastic foam material having a top surface and a bottom surface, the top surface being attached to the inner surface of the shell, the bottom surface being generally planar and having a first fluoropolymer coating adhered thereto; and a second foam pad constructed of an energy absorbing viscoelastic foam material having a top surface and a bottom surface, the top surface of the second foam pad being generally planar and having a second fluoropolymer coating adhered thereto, the first and second foam pads being positioned with the first and second fluoropolymer coatings being in sliding facing engagement, the bottom surface of the second foam pad being a substantially flat surface which is substantially tangent to the surface of the wearer's head beneath it when the helmet is worn, the at least one of the second type of subliner element being positioned between the plurality of the first type of subliner elements and the third type of subliner element.

20. The helmet as recited in claim 19, wherein the first and second fluoropolymer coatings are biased toward each other by a force applied to the first and second foam pads.

21. The helmet as recited in claim 19, wherein the first foam pad has a first side surface extending between the top and bottom surfaces thereof, the second foam pad has a second side surface extending between the top and bottom surfaces thereof, a first rib secured to the first side surface, a second rib secured to a second side surface and a biasing element extending between the first and second ribs to force the first and second fluoropolymer coatings toward each other.

22. The helmet as recited in claim 21 wherein the biasing element consists of one or more elastic spring elements.

23. The helmet as recited in claim 22 wherein the elastic spring elements are constructed of a material selected from the group consisting of metal, polymer and elastomer.

24. The helmet as recited in claim 19, wherein the first and second foam pads are comprised of an energy absorbing viscoelastic foam material capable of exhibiting a compressive stress of at least 50 psi for a dynamic compression of 50%.

25. The helmet as recited in claim 19 further comprising:

an outer shell comprised of a hard impact resistant material, the outer shell having inner and outer surfaces, the outer shell surrounding at least a portion of the subliner shell, the inner surface of the outer shell being spaced from the outer surface of the subliner shell at an initial pre-impact relative position; and a plurality of outer liner elements located in the space between the outer surface of the subliner shell and the inner surface of the outer shell and attached to both the outer surface of the subliner shell and the inner surface of the outer shell wherein at least one of the outer liner elements is comprised of an energy absorbing viscoelastic foam.

26. The helmet as recited in claim 25 wherein the outer liner elements are radially partitioned into individual and independent segments, the independent segments are nested with respect to each other with double-sided nano tape positioned therebetween such that the nested segments have side surfaces in direct contacting engagement with the nano tape.

27. The helmet as recited in claim 19 wherein the first type of subliner elements are radially partitioned into individual and independent segments, the independent segments are nested with respect to each other with double-sided nano tape positioned therebetween such that the nested segments have side surfaces in direct contacting engagement with the nano tape.

* * * * *